US006909374B2

(12) United States Patent
Fong

(10) Patent No.: US 6,909,374 B2
(45) **Date of Patent: *Jun. 21, 2005**

(54) LEVEL/POSITION SENSOR AND RELATED ELECTRONIC CIRCUITRY FOR INTERACTIVE TOY

(76) Inventor: Peter Sui Lun Fong, 297F S. Atlantic Blvd., Monterey, CA (US) 91754

( * ) Notice: Subject to any disclaimer, the term of this patent is extended or adjusted under 35 U.S.C. 154(b) by 355 days.

This patent is subject to a terminal disclaimer.

(21) Appl. No.: 10/179,569

(22) Filed: Jun. 25, 2002

(65) Prior Publication Data

US 2002/0196156 A1 Dec. 26, 2002

Related U.S. Application Data

(63) Continuation of application No. 09/568,900, filed on May 11, 2000, now Pat. No. 6,437,703, which is a continuation-in-part of application No. 09/478,388, filed on Jan. 6, 2000, now Pat. No. 6,377,187.

(51) Int. Cl.[7] ..... G08B 21/00

(52) U.S. Cl. ..... 340/689; 340/686.1; 200/61.52; 345/158; 73/504.02; 73/514.02; 73/652; 463/37; 446/234

(58) Field of Search ..... 340/686.1, 689, 340/687, 690; 200/61.52, 244, 61.45 R, 61.45 M; 345/158; 33/366.24, 366.11; 73/514.02, 504.02, 652, 515.02, 515.37, 515.16, 515.21; 463/37; 446/234

(56) References Cited

U.S. PATENT DOCUMENTS

| | | | | | |
|---|---|---|---|---|---|
| 3,460,028 | A | * | 8/1969 | Beaver et al. | 324/220 |
| 3,601,729 | A | | 8/1971 | Hierta | 335/205 |
| 4,321,438 | A | | 3/1982 | Emenegger | 200/61.45 R |
| 4,339,747 | A | | 7/1982 | Maybee | 340/547 |
| 4,375,727 | A | * | 3/1983 | McAdams et al. | 33/366.24 |
| 4,390,928 | A | | 6/1983 | Runge | 362/101 |
| 4,493,155 | A | * | 1/1985 | Comeau et al. | 33/366.26 |
| 4,503,299 | A | * | 3/1985 | Henrard et al. | 200/61.52 |
| 4,644,662 | A | * | 2/1987 | Anderson et al. | 33/366.19 |
| 4,672,753 | A | * | 6/1987 | Kent et al. | 33/366.19 |
| 4,700,479 | A | * | 10/1987 | Saito et al. | 33/366.24 |
| 4,803,342 | A | | 2/1989 | Steers et al. | 219/257 |
| 4,811,492 | A | * | 3/1989 | Kakuta et al. | 33/366.25 |
| 4,866,850 | A | | 9/1989 | Kelly et al. | 33/366.22 |
| 5,026,157 | A | * | 6/1991 | Winckler | 356/250 |
| 5,059,958 | A | * | 10/1991 | Jacobs et al. | 345/158 |
| 5,130,693 | A | | 7/1992 | Gigandet | 340/815.69 |
| 5,168,138 | A | * | 12/1992 | Evans | 200/61.52 |

(Continued)

*Primary Examiner*—Benjamin C. Lee
(74) *Attorney, Agent, or Firm*—Stetina Brunda Garred & Brucker

(57) ABSTRACT

A sensor for use in an interactive electronic device. The sensor comprises a base member having at least one recess formed therein which is partially defined by a peripheral wall thereof. Disposed within the peripheral wall of the base member is at least one switch. Also disposed within the recess is a trigger ball which is freely movable about the peripheral wall of the base member. The sensor is operative to generate at least two different states corresponding to respective positions of the sensor relative to a reference plane. The movement of the sensor relative to the reference plane facilitates the movement of the trigger ball within the recess, with one state being generated when the trigger ball is in contact with the switch and another state being generated when the trigger ball is not in contact with the switch.

28 Claims, 24 Drawing Sheets

U.S. PATENT DOCUMENTS 5,168,264 A 12/1992 Agustin ..... 340/573.7
5,209,343 A 5/1993 Romano et al. ..... 200/61.52
5,300,921 A 4/1994 Hoch et al. ..... 340/573.6
5,434,559 A * 7/1995 Smiley et al. ..... 340/571
5,450,049 A 9/1995 Bachmann ..... 335/205
5,495,762 A * 3/1996 Tamura et al. ..... 73/519.01
5,529,070 A * 6/1996 Augustine et al. ..... 600/443
5,610,338 A 3/1997 Kato et al. ..... 73/652
5,646,601 A * 7/1997 Wallace et al. ..... 340/686.1
5,798,912 A * 8/1998 Brown et al. ..... 362/496
5,929,767 A * 7/1999 Wallick ..... 340/690
5,992,849 A 11/1999 Olti et al. ..... 273/153 R
6,106,398 A 8/2000 Davis ..... 463/38
6,129,686 A * 10/2000 Friedman ..... 600/595
6,157,898 A 12/2000 Marinelli ..... 702/141
6,200,219 B1 * 3/2001 Rudell et al. ..... 463/37
6,215,978 B1 * 4/2001 Ruzic et al. ..... 434/311
6,399,941 B1 * 6/2002 Nakagaki et al. ..... 250/231.13

* cited by examiner

Fig. 34
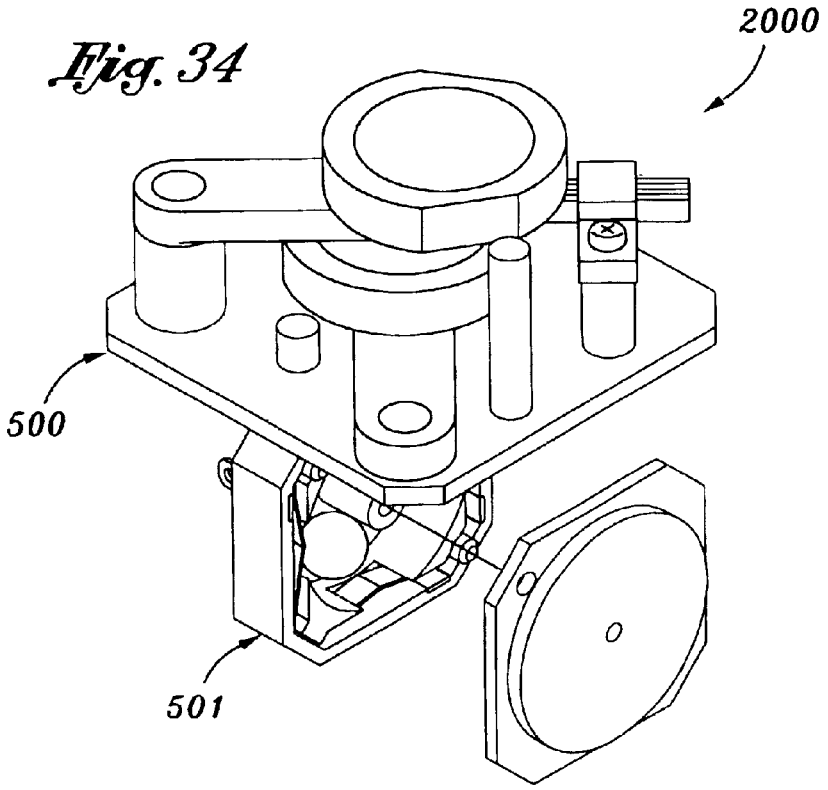
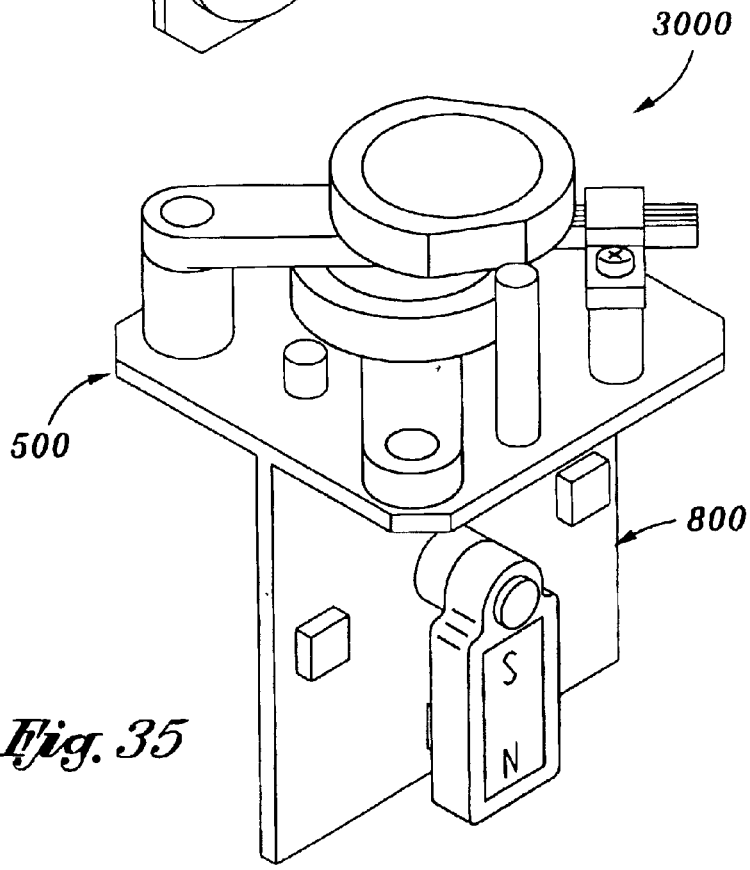
Fig. 35

*Fig. 36*

| POSITION OF TRIGGER BALL $Z_b$ | | TRIGGER BALL $Z_a$ | TRIGGER BALL $Z_b$ | TRIGGER BALL $Z_c$ |
|---|---|---|---|---|
| No. | DEGREE | | | |
| 1 | 22.5° | L | L | L |
| 2 | 45° | H(360°) | L(45°) | H(90°) |
| 3 | 67.5° | L | L | L |
| 4 | 90° | L(45°) | H(90°) | L(135°) |
| 5 | 112.5° | L | L | L |
| 6 | 135° | H(90°) | L(135°) | H(180°) |
| 7 | 157.5° | L | L | L |
| 8 | 180° | L(135°) | H(180°) | L(225°) |
| 9 | 202.5° | L | L | L |
| 10 | 225° | H(180°) | L(225°) | H(270°) |
| 11 | 247.5° | L | L | L |
| 12 | 270° | L(225°) | H(270°) | L(315°) |
| 13 | 292.5° | L | L | L |
| 14 | 315° | H(270°) | L(315°) | H(360°) |
| 15 | 337.5° | L | L | L |
| 16 | 360° | L(315°) | H(360°) | L(45°) |

LEVEL/POSITION SENSOR AND RELATED ELECTRONIC CIRCUITRY FOR INTERACTIVE TOY

CROSS-REFERENCE TO RELATED APPLICATIONS

The present application is a continuation of U.S. application Ser. No. 09/568,900 entitled LEVEL/POSITION SENSOR AND RELATED ELECTRONIC CIRCUITRY FOR INTERACTIVE TOY filed May 11, 2000 now U.S. Pat. No. 6,437,703, which is a continuation-in-part of U.S. application Ser. No. 09/478,388 entitled LEVEL/POSITION SENSOR AND RELATED ELECTRONIC CIRCUITRY FOR INTERACTIVE TOY filed Jan. 6, 2000, now issued as U.S. Pat. No. 6,377,187 on Apr. 23, 2002.

STATEMENT RE: FEDERALLY SPONSORED RESEARCH/DEVELOPMENT (Not Applicable)

BACKGROUND OF THE INVENTION

The present invention relates generally to interactive electronic toys, and more particularly to a uniquely configured sensor and associated electronic circuitry which may be incorporated into interactive electronic toys and games (including dolls and remote controllers such as joysticks) and is operative to produce various visual and/or audible outputs or signal transmissions corresponding to the level/position of the toy relative to a prescribed plane.

There is currently known in the prior art a multitude of interactive electronic toys which are capable of producing a wide variety of visual and/or audible outputs. In the prior art toys, these outputs are typically triggered as a result of the user (e.g., a child) actuating one or more switches of the toy. The switch(es) of the prior art toys are most typically actuated by pressing one or more buttons on the toy, opening and/or closing a door or a hatch, turning a knob or handle, inserting an object into a complimentary receptacle, etc. In certain prior art interactive electronic toys, the actuation of the switch is facilitated by a specific type of movement of the toy. However, in those prior art electronic toys including a motion actuated switch, such switch is typically capable of generating only a single output signal as a result of the movement of the toy.

The present invention provides a uniquely configured sensor and associated electronic circuitry which is particularly suited for use in interactive electronic toys and games, including dolls and remote controllers such as joysticks. The present sensor is specifically configured to generate a multiplicity of different output signals which are a function of (i.e., correspond to) the level/position of the toy relative to a prescribed plane. Thus, interactive electronic toys and games incorporating the sensor and associated electronic circuitry of the present invention are far superior to those known in the prior art since a wide variety of differing visual and/or audible outputs and/or various signal transmissions may be produced simply by varying or altering the level/position of the toy relative to a prescribed plane. For example, the incorporation of the sensor and electronic circuitry of the present invention into an interactive electronic toy such as a spaceship allows for the production of differing visual and/or audible outputs as a result of the spaceship being tilted in a nose-up direction, tilted in a nose-down direction, banked to the left, and banked to the right. As indicated above, the output signals generated by the sensor differ according to the level/position of the sensor relative to a prescribed plane, with the associated electronic circuitry of the present invention being operative to facilitate the production of various visual and/or audible outputs corresponding to the particular output signals generated by the sensor.

If incorporated into a joystick or other remote controller, the present sensor and associated electronic circuitry may be configured to facilitate the production of the aforementioned visual and/or audible outputs, and/or generate electrical/electronic signals, radio signals, infrared signals, microwave signals, or combinations thereof which may be transmitted to another device to facilitate the control and operation thereof in a desired manner. The frequency and/or coding of the radio, microwave, or electrical/electronic signals and the coding of the infrared signals transmitted from the joystick or other remote controller would be variable depending upon the level or position of the same relative to a prescribed plane. Moreover, the present electronic circuitry may be specifically programmed to memorize or recognize a prescribed sequence of movements of the sensor relative to a prescribed plane. More particularly, a prescribed sequence of states or output signals generated by the sensor corresponding to a prescribed sequence of movements thereof, when transmitted to the electronic circuitry, may be used to access a memory location in the electronic circuitry in a manner triggering or implementing one or more preprogrammed visual and/or audible functions or effects and/or the transmission of various electrical (hard wired), infrared, radio, or microwave signals to another device for communication and/or activation of various functions thereof. These, and other unique attributes of the present invention, will be discussed in more detail below.

SUMMARY OF THE INVENTION

In accordance with a fifth embodiment of the present invention, there is provided a sensor for use in an interactive electronic device. The sensor comprises a base member having at least one recess formed therein which is partially defined by a peripheral wall thereof. Disposed within the peripheral wall of the base member is at least one switch, while disposed within the recess is at least one trigger ball which is freely movable about the peripheral wall. The sensor is operative to generate at least two different states corresponding to respective positions of the sensor relative to a reference plane, with the movement of the sensor relative to the reference plane facilitating the movement of the trigger ball within the recess. In the sensor of the fifth embodiment, one state is generated when the trigger ball is in contact with the switch, with another state being generated when the trigger ball is not in contact with the switch.

In the sensor of the fifth embodiment, the peripheral wall of the base member is preferably circularly configured, with at least four switches preferably being disposed within the peripheral wall at intervals of approximately ninety degrees. In this respect, the sensor is operative to generate a low state when the trigger ball is not in contact with any of the switches, and at least four different high states corresponding to the contact between the trigger ball and respective ones of the switches. The base member of the sensor of the fifth embodiment may be configured to define first and second axes which extend in generally perpendicular relation to each other, with two circularly configured recesses being formed within the base member such that the first and second axes extend axially through respective ones of the recesses. Assuming each of the recesses includes four switches disposed within the peripheral wall thereof at intervals of approximately ninety degrees and at least one trigger ball is disposed within each of the recesses, the sensor would be operative to generate the low state when the trigger balls are not in contact with any of the switches, and at least sixteen different high states corresponding to the contact between the trigger balls and respective ones of the switches.

The base member may alternatively be configured to define first, second and third axes which extend in generally perpendicular relation to each other, with three circularly configured recesses being formed within the base member such that the first, second and third axes extend axially through respective ones of the recesses. Assuming that the peripheral wall of each of the recesses includes four switches disposed therein at intervals of approximately ninety degrees and at least one trigger ball is disposed within each of the recesses, the sensor would be operative to generate the low state when the trigger balls are not in contact with any of the switches, and at least sixty-four different high states corresponding to the contact between the trigger balls and respective ones of the switches.

Rather than including four switches, the recess(es) of the sensor may include two, three, or more than four switches within the peripheral wall(s) thereof. In the single axis, two switch combination, the sensor would be operative to generate the low state when the trigger ball is not contact with any of the switches and at least two different high states corresponding to the contact between the trigger ball and respective ones of the switches. In the two-axis, two switch combination, the sensor would be operative to generate the low state when the trigger balls are not in contact with any of the switches, and at least four different high states corresponding to the contact between the trigger balls and respective ones of the switches. In the three-axis, two switch combination, the sensor would be operative to generate the low state when the trigger balls are not in contact with any of the switches, and at least eight different high states corresponding to the contact between the trigger balls and respective ones of the switches.

The sensor of the fifth embodiment is preferably used in combination with programmable electronic circuitry which is in electrical communication with the sensor and operative to compare at least two successive states generated by the sensor to each other. The electronic circuitry may be programmed to translate at least some of the states generated by the sensor into respective effects which may comprise visual outputs, audible outputs, and combinations thereof. The effects may alternatively comprise electrical signals of differing frequencies and/or codings, infrared signals of differing codings, radio signals of differing frequencies and/or codings, microwave signals of differing frequencies and/or codings, and combinations thereof. As will be recognized, the successive states generated by the sensor which are compared by the electronic circuitry correspond to the movement of the trigger ball(s) within the recess(es). Each switch of the sensor of the fifth embodiment preferably comprises a resilient primary lead which is disposed within the peripheral wall and moveable between flexed and unflexed positions. In addition to the primary lead, each switch comprises a secondary lead which is disposed within the base member. The primary lead normally resides in the unflexed position, with the movement of the corresponding trigger ball into contact with the primary, lead facilitating the deflection thereof to the flex position and resulting in electrical contact with the secondary lead.

In accordance with the sixth and seventh embodiments of the present invention, there is provided a sensor for use in an interactive electronic device. The sensor of the sixth and seventh embodiments comprises a base member having at least one recess formed therein which is partially defined by a peripheral wall thereof. Disposed within the peripheral wall of the base member are at least two switches, while disposed within the recess is a trigger mechanism which is freely moveably about the peripheral wall. The sensor is operative to generate at least four different states corresponding to respective positions of the sensor relative to a reference plane, with the movement of the sensor relative to the reference plane facilitating the movement of the trigger mechanism within the recess. A low state is generated when the trigger mechanism is not in contact with either of the switches, with two different high states being generated corresponding to contact between the trigger mechanism and respective ones of the switches, and another high state being generated when the trigger mechanism is simultaneously in contact with both of the switches.

In the sensor of the sixth and seventh embodiments, the peripheral wall of the base member is preferably circularly configured, with at least four switches preferably being disposed within the peripheral wall at intervals of approximately ninety degrees. In this respect, the sensor is operative to generate the low state when the trigger mechanism is not in contact with any of the switches, four different high states corresponding to contact between the trigger mechanism and respective ones of the switches, and four additional different high states corresponding to the trigger mechanism being in simultaneous contact with any pair of the switches separated by a ninety degree interval. In the sixth embodiment, the trigger mechanism comprises a plurality (i.e., three) spherically shaped trigger balls and a retainer member which is rotatably connected to the base member and operative to maintain the trigger balls in side-by-side relation to each other. In the seventh embodiment, the trigger mechanism comprises a trigger plate which is rotatably connected to the base member and defines an arcuate surface having three protuberances extending radially therefrom at intervals of approximately forty-five degrees. In the seventh embodiment, the switches of the sensor are configured such that the trigger plate serves as a conductor which completes an electrical circuit with at least one of the switches.

The base member of the sensor of the sixth and seventh embodiments may be configured to define first and second axes which extend in generally perpendicular relation to each other, with two circularly configured recesses being formed within the base member such that the first and second axes extend axially through respective ones of the recesses. Assuming each of the recesses include four switches disposed within the peripheral wall thereof at intervals of approximately ninety degrees and a trigger mechanism is disposed within each of the recesses, the sensor would be operative to generate the low state when the trigger mechanisms are not in contact with any of the switches, and at least sixty-four different high states corresponding to contact between the trigger mechanisms and at least one of the switches. The base member may alternatively be configured to define first, second and third axes which extend in generally perpendicular relation to each other, with three circularly configured recesses being formed within the base member such that the first, second and third axes extend axially through respective ones of the recesses. Assuming that the peripheral wall of each of the recesses includes four switches disposed therein at intervals of approximately ninety degrees and a trigger mechanism is disposed within each of the recesses, the sensor would be operative to generate the low state when the trigger mechanisms are not in contact in with any of the switches, and at least five hundred twelve different high states corresponding to the contact between the trigger mechanisms and at least one of the switches.

Rather than including four switches, the recess(es) of the sensor may include three or more than four switches within the peripheral wall(s) thereof. As indicated above, two switches may be included in the peripheral wall(s) of the recess(es). In the two-axis, two switch combination, the sensor would be operative to generate the low state when the trigger mechanisms are not in contact with any of the switches, and at least nine different high states corresponding to contact between the trigger mechanisms and at least one of the switches. In the three-axis, two switch combination, the sensor would be operative to generate the low state when the trigger mechanisms are not in contact with any of the switches, and at least twenty-seven different high states corresponding to contact between the trigger mechanisms and at least one of the switches.

The sensor of the sixth and seventh embodiments is also preferably used in combination with programmable electronic circuitry which is in electrical communication with the sensor and operative to compare at least two successive states generated by the sensor to each other. The electronic circuitry may be programmed to translate at least some of the states generated by the sensor into respective effects in the same manner previously described in relation to the electronic circuitry of the sensor of the fifth embodiment. As will be recognized, the successive states generated by the sensor which are compared by the electronic circuitry correspond to the movement of the trigger mechanism(s) within the recess(es).

In the two-axis version of the sensor of the sixth and seventh embodiments, the base member may comprise two separate base member sections which define respective ones of the first and second axes. The recesses are formed within respective ones of the base member sections, with the first and second axes extending axially through respective ones of the recesses. The base member sections are attachable to a device such that the first and second axes extend in generally perpendicular relation to each other. Similarly, in the three-axis version of the sensor of the sixth and seventh embodiments, the base member may comprise three separate base member sections which define respective ones of the first, second and third axes. The recesses are formed within respective ones of the base member sections, with the first, second and third axes extending axially through respective ones of the recesses. The base member sections are attachable to a device such that the first, second and third axes extend in generally perpendicular relation to each other. Those devices/items to which the sensor of the sixth and seventh embodiments may be interfaced include vehicles (i.e., bicycles, tricycles, skateboards, scooters), vests, belts, gloves, or other garments, and footwear (i.e., athletic shoes, roller blades).

In accordance with eighth and ninth embodiments of the present invention, there is provided a sensor for use in an interactive electronic device. The sensor comprises a base mount defining at least one face, and at least one switch which is attached to the face of the base mount. Rotatably connected to the face of the base mount is at least one sensor arm. Attached to the sensor arm is at least one magnet which produces a magnetic field. The switch is oriented relative to the sensor arm such that the switch may be exposed to the magnetic field of the magnet upon the rotation of the sensor arm. The sensor is operative to generate at least two different states corresponding to respective positions of the sensor relative to a reference plane, with the movement of the sensor relative to the reference plane facilitating the rotation of the sensor arm. One state is generated when the switch is exposed to the magnetic field of the magnet, with another state being generated when the switch is not exposed to the magnetic field of the magnet.

In the sensor of the eighth embodiment, at least four switches are preferably attached to the face of the base mount in a generally circular pattern at intervals of approximately ninety degrees. In this respect, the sensor is operative to generate a low state when none of the switches are exposed to the magnetic field of the magnet, and at least four different high states corresponding to the exposure of respective ones of the switches to the magnetic field of the magnet. In the ninth embodiment, at least eight switches are attached to the face of the base mount in a generally circular pattern at intervals of approximately forty-five degrees, with the sensor being operative to generate the low state when none of the switches are exposed to the magnetic field of the magnet, and at least eight different high states corresponding to the exposure of respective ones of the switches to the magnetic field of the magnet.

In the sensor of the eighth embodiment, the base mount may define at least first and second faces which extend in generally perpendicular relation to each other. Assuming each of the faces includes four switches disposed thereon in a generally circular pattern at intervals of approximately ninety degrees and a sensor arm is rotatably connected to each of the first and second faces, the sensor would be operative to generate the low state when none of the switches are exposed to the magnetic field of the magnet of any one of the sensor arms, and at least sixteen different high states corresponding to the exposure of respective ones of the switches to the magnetic field of the magnet of respective ones of the sensor arms. Similarly, the base mount of the sensor of the ninth embodiment may define at least first and second faces which extend in generally perpendicular relation to each other. Assuming at least eight switches are disposed on each of the first and second faces in a generally circular pattern at intervals of approximately forty-five degrees and a sensor arm is rotatably connected to each of the first and second faces, the sensor of the ninth embodiment would be operative to generate the low state when none of the switches are exposed to the magnetic field of the magnet of any one of the sensor arms, and at least sixty-four different high states corresponding to the exposure of respective ones of the switches to the magnetic field of the magnet of respective ones of the sensor arms.

Moreover, the base mount of the sensor of the eighth embodiment may be configured to define first, second and third faces which extend in generally perpendicular relation to each other. Assuming at least four switches are disposed on each of the first, second and third faces in a generally circular pattern at intervals of approximately ninety degrees and a sensor arm is rotatably connected to each of the first, second and third faces, the sensor of the eighth embodiment would be operative to generate the low state when none of the switches are exposed to the magnetic field of the magnet of any one of the sensor arms, and at least sixty-four different high states corresponding to the exposure of respective ones of the switches to the magnetic field of the magnet of respective ones of the sensor arms. Similarly, the base mount of the sensor of the ninth embodiment may be configured to define first, second and third faces which extend in generally perpendicular relation to each other. Assuming at least eight switches are disposed on each of the first, second and third faces in a generally circular pattern at intervals of approximately forty-five degrees and a sensor arm is rotatably connected to each of the first, second and third faces, the sensor of the ninth embodiment would be operative to generate the low state when none of the switches are exposed to the magnetic field of the magnet of any one of the sensor arms, and at least five hundred twelve different high states corresponding to the exposure of respective ones of the switches to the magnetic field of the magnet of respective ones of the sensor arms.

Rather than including four switches, the sensor of the eighth embodiment may include two switches disposed on the face(es) thereof. In the single face, two switch combination, the sensor would be operative to generate the low state when neither of the switches are exposed to the magnetic field of the magnet, and at least two different high states corresponding to the exposure of respective ones of the switches to the magnetic field of the magnet. In the two face, two switch combination, the sensor would be operative to generate the low state when none of the switches are exposed to the magnetic field of the magnet of any one of the sensor arms, and at least four different high states corresponding to the exposure of respective ones of the switches to the magnetic field of the magnet of respective ones of the sensor arms. Finally, in the three face, two switch combination, the sensor would be operative to generate the low state when none of the switches are exposed to the magnetic field of the magnet of any one of the sensor arms, and at least eight different high states corresponding the exposure of respective ones of the switches to the magnetic field of the magnet of respective ones of the sensor arms.

In the sensors of the eighth and ninth embodiments, the switches preferably comprise either Hall effect switches or Reed switches. The sensors of the eighth and ninth embodiments are also preferably used in combination with programable electronic circuitry which is in electrical communication with the sensor and is operative to compare at least two successive states generated by the sensor to each other. The electronic circuitry may be programmed to translate at least some of the states generated by the sensor into respective effects in the same manner previously described in relation to the electronic circuitry of the sensor of the fifth embodiment. As will be recognized, the successive states generated by the sensor which are compared by the electronic circuitry correspond to the rotation of the sensor arm(s) relative to the face(es).

In accordance with a tenth embodiment of the present invention, there is provided a sensor for use in an interactive electronic device. The sensor of the tenth embodiment comprises a base mount defining at least one face, and at least two switches which are attached to the face of the base mount. Rotatably connected to the face of the base mount is at least one trigger magnet which produces a magnetic field. The switches are oriented relative to the trigger magnet such that the trigger magnet is passable over the switches upon the rotation of the trigger magnet. The sensor of the tenth embodiment is operative to generate at least four different states corresponding to respective positions of the sensor relative to a reference plane, with the movement of the sensor relative to the reference plane facilitating the rotation of the trigger magnet. A low state is generated when neither of the switches are exposed to the magnetic field of the trigger magnet, with two different high states being generated corresponding to the exposure of respective ones of the switches to the magnetic field of the trigger magnet, and another high state being generated when both of the switches are simultaneously exposed to the magnetic field of the trigger magnet.

In the sensor of the tenth embodiment, at least four switches are preferably attached to the face of the base mount in a generally circular pattern at intervals of approximately ninety degrees. In this respect, the sensor is operative to generate the low state when none of the switches are exposed to the magnetic field of the trigger magnet, four different high states corresponding to the exposure of respective ones of the switches to the magnetic field of the trigger magnet, and four additional different high states corresponding to the simultaneous exposure of any pair of the switches separated by a ninety degree interval to the magnetic field of the trigger magnet.

The base mount of the sensor of the tenth embodiment may be configured to define at least first and second faces which extend in generally perpendicular relation to each other. Assuming that at least four switches are disposed on each of the first and second faces in a generally circular pattern at intervals of approximately ninety degrees and a trigger magnet is rotatably connected to each of the first and second faces, the sensor would be operative to generate the low state when none of the switches are exposed to the magnetic field of any one of the trigger magnets, and at least sixty-four different high states corresponding to the exposure of at least one of the switches to the magnetic field of at least one of the trigger magnets. The base mount may alternatively be configured to define first, second and third faces which extend in generally perpendicular relation to each other. Assuming that at least four switches are disposed on each of the first, second and third faces in a generally circular pattern at intervals of approximately ninety degrees and a trigger magnet is rotatably connected to each of the first, second and third faces, the sensor would be operative to generate the low state when none of the switches are exposed to the magnetic field of any one of the trigger magnets, and at least five hundred twelve different high states corresponding to the exposure of at least one of the switches to the magnetic field of at least one of the trigger magnets.

Rather than including four switches, the two face and three face versions of the sensor of the tenth embodiment may include two switches. In the two face, two switch combination, the sensor would be operative to generate the low state when none of the switches are exposed to the magnetic field of any one of the trigger magnets, and at least nine different high states corresponding to the exposure of at least one of the switches to the magnetic field of at least one of the trigger magnets. In the three face, two switch combination, the sensor would operative to generate the low state when none of the switches are exposed to the magnetic field of any one of the trigger magnets, and at least twenty-seven different high states corresponding to the exposure of at least one of the switches to the magnetic field of at least one of the trigger magnets.

The switches of the sensor of the tenth embodiment also each preferably comprise either a Hall effect switch or a Reed switch. The sensor of the tenth embodiment is itself preferably used in combination with programmable electronic circuitry which is in electrical communication with the sensor and operative to compare at least two successive states generated by the sensor to each other. The electronic circuitry may be programmed to translate at least some of the states generated by the sensor into respective effects in the same manner previously described in relation to the electronic circuitry of the sensor of the fifth embodiment. As will be recognized, the successive states generated by the sensor which are compared by the electronic circuitry correspond to the rotation of the trigger magnet(s) relative to the face(es)

BRIEF DESCRIPTION OF THE DRAWINGS

These, as well as other features of the present invention, will become more apparent upon reference to the drawings wherein:

FIG. 34 is a perspective view of a sensor constructed in accordance with an eleventh embodiment of the present invention;

FIG. 35 is a perspective view of a sensor constructed in accordance with a twelfth embodiment of the present invention;

FIG. 36 is a chart illustrating the various conditions which may be generated by the sensor of the sixth or seventh embodiments of the present invention;

DETAILED DESCRIPTION OF THE INVENTION

Figure 1:
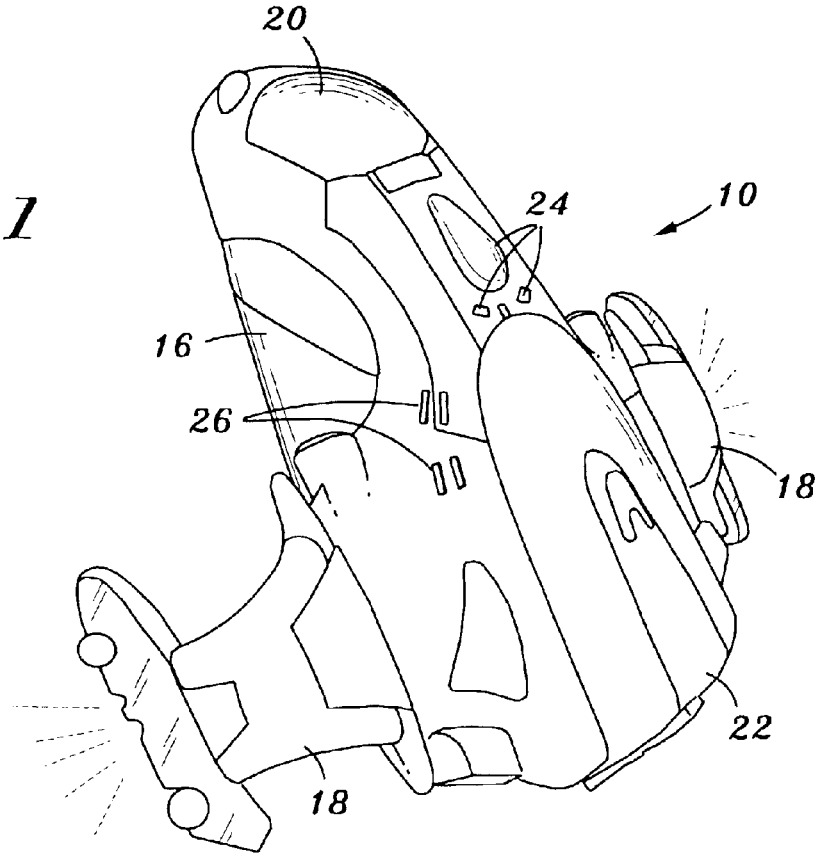
FIG. 1 is a perspective view of an exemplary interactive electronic toy incorporating the sensor and associated electronic circuitry of the present invention.
Figure 2:
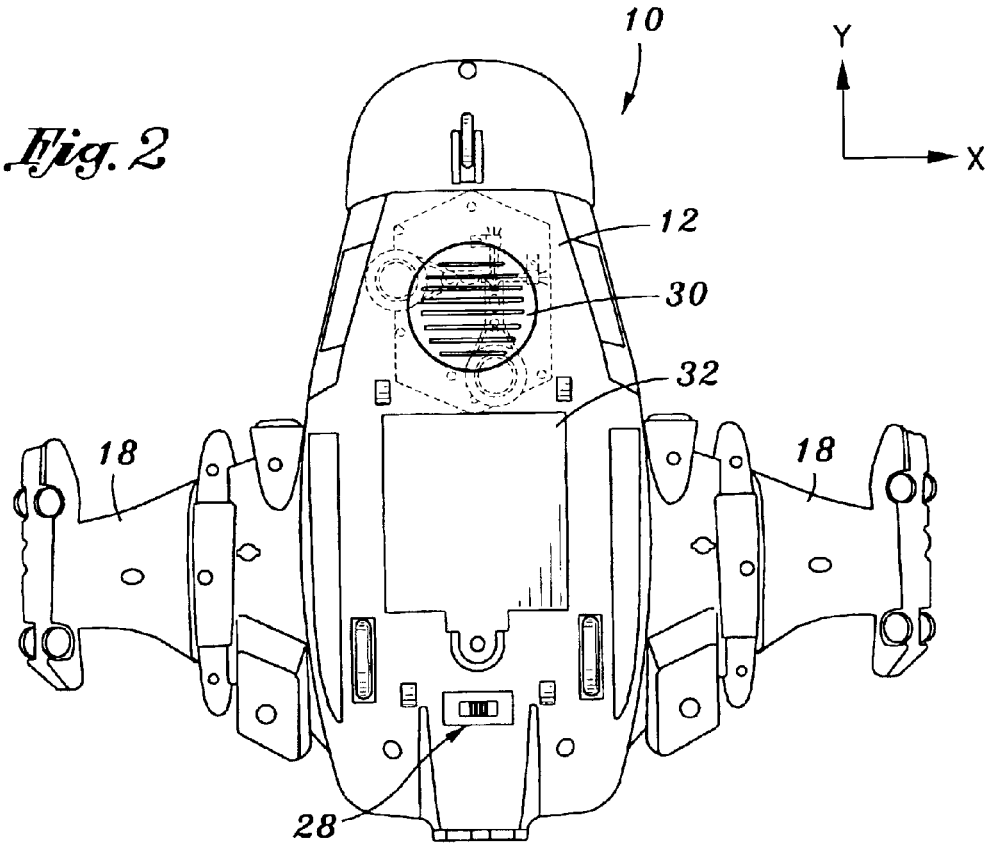
FIG. 2 is a bottom plan view of the interactive electronic toy shown in FIG. 1, further illustrating in phantom a sensor constructed in accordance with a first embodiment of the present invention.
Figure 9:
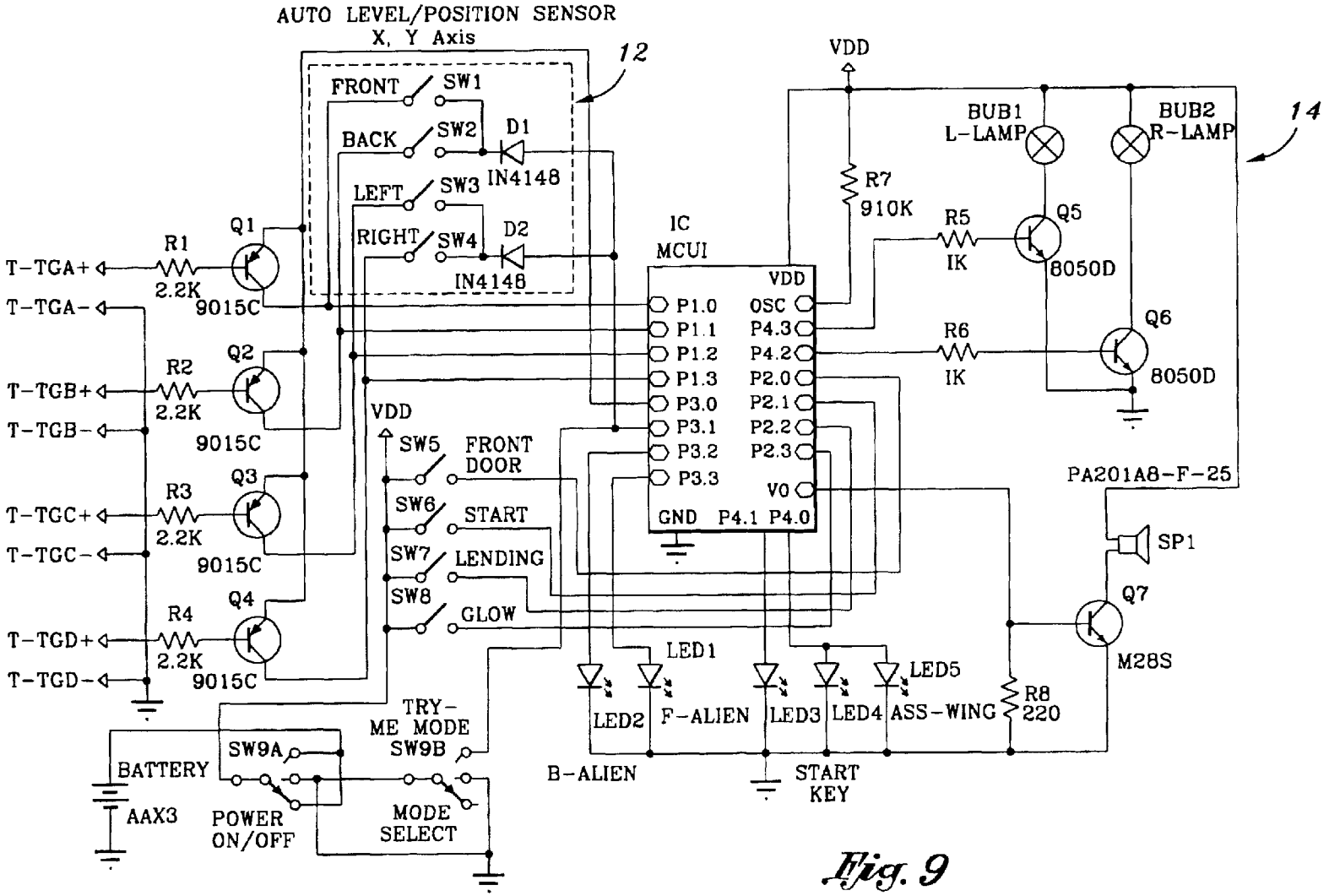
FIG. 9 is a schematic of exemplary electronic circuitry which may be used in conjunction with the sensor of the first embodiment for incorporation into an interactive electronic spaceship.

Referring now to the drawings wherein the showings are for purposes of illustrating preferred embodiments of the present invention only, and not for purposes of limiting the same, FIGS. 1 and 2 illustrate an exemplary interactive electronic toy (i.e., a spaceship 10) incorporating the sensor 12 of the first embodiment of the present invention (shown in FIGS. 3–5) and its associated electronic circuitry 14 (schematically illustrated in FIG. 9). Those of ordinary skill in the art will recognize that the sensor 12 of the first embodiment, as well as the sensor 112 of the second embodiment (shown in FIG. 6) may be incorporated into interactive electronic toys or games other than for the spaceship 10, or into interactive electronic devices other than for toys and games. For example, the sensor 12 or sensor 112 may be incorporated into an interactive doll or an interactive remote controller such as a joystick. As will be discussed in more detail below, different electronic circuitry is employed in relation to the present invention, depending on whether the sensor 12 or sensor 112 is incorporated into the interactive electronic device, and the particular type of switches employed in the sensor 12 or sensor 112.

The spaceship 10 shown in FIGS. 1 and 2 includes a fuselage 16 having an opposed pair of collapsible wings 18 extending from respective sides thereof. Attached to the front of the fuselage 16 is an openable and closable front door 20, while attached to the top of the fuselage 16 is an openable and closable top door 22. The front door 20 is operatively coupled to a switch which is electrically connected to the electronic circuitry 14 and actuated by the movement of the front door 20 from its closed position (shown in FIG. 1) to its open position. Protruding from the top of the fuselage 16 are three (3) depressible buttons 24 which are each preferably located between the front and top doors 20, 22. The buttons 24 are operatively coupled to respective switches which are each electrically connected to the electronic circuitry 14. Also provided on the top of the fuselage 16 about the periphery of the top door 22 are four (4) contact regions 26 which are also each electrically connected to the electronic circuitry 14.

In addition to the aforementioned components, the spaceship 10 is also provided with an on/off switch 28 which is located in the bottom of the fuselage 16 thereof. The on/off switch 28 is electrically connected to the electronic circuitry 14 as well, and is moveable between three (3) different modes, including an on mode, an off mode, and a "try-me" mode. The sensor 12 is disposed within the interior of the fuselage 16 in relative close proximity to the nose thereof, as is best shown in FIG. 2. The electronic circuitry 14 is also disposed within the interior of the fuselage 16. Attached to the bottom of the fuselage 16 adjacent the sensor 12 is a speaker 30 which is electrically connected to the electronic circuitry 14 and operative to transmit or generate audible outputs from the spaceship 10.

Also disposed within the bottom of the fuselage 16 between the speaker 30 and on/off switch 28 is a battery compartment 32 which accommodates multiple batteries. The batteries stored within the battery compartment 32 are electrically connected to the electronic circuitry 14 and provide power thereto, as well as to the sensor 12 via the electronic circuitry 14. The spaceship 10 is also preferably outfitted with a plurality of LED's which are disposed within the fuselage 16, wings 18, buttons 24, and underneath the front and top doors 20, 22. These LED's are each electrically connected to the electronic circuitry 14, and receive power from the batteries within the battery compartment 32 via the electronic circuitry 14. As previously indicated, the spaceship 10 as described above is exemplary of only a single interactive electronic toy in which the sensor 12 or sensor 112 of the present invention may be included.

Figure 3:
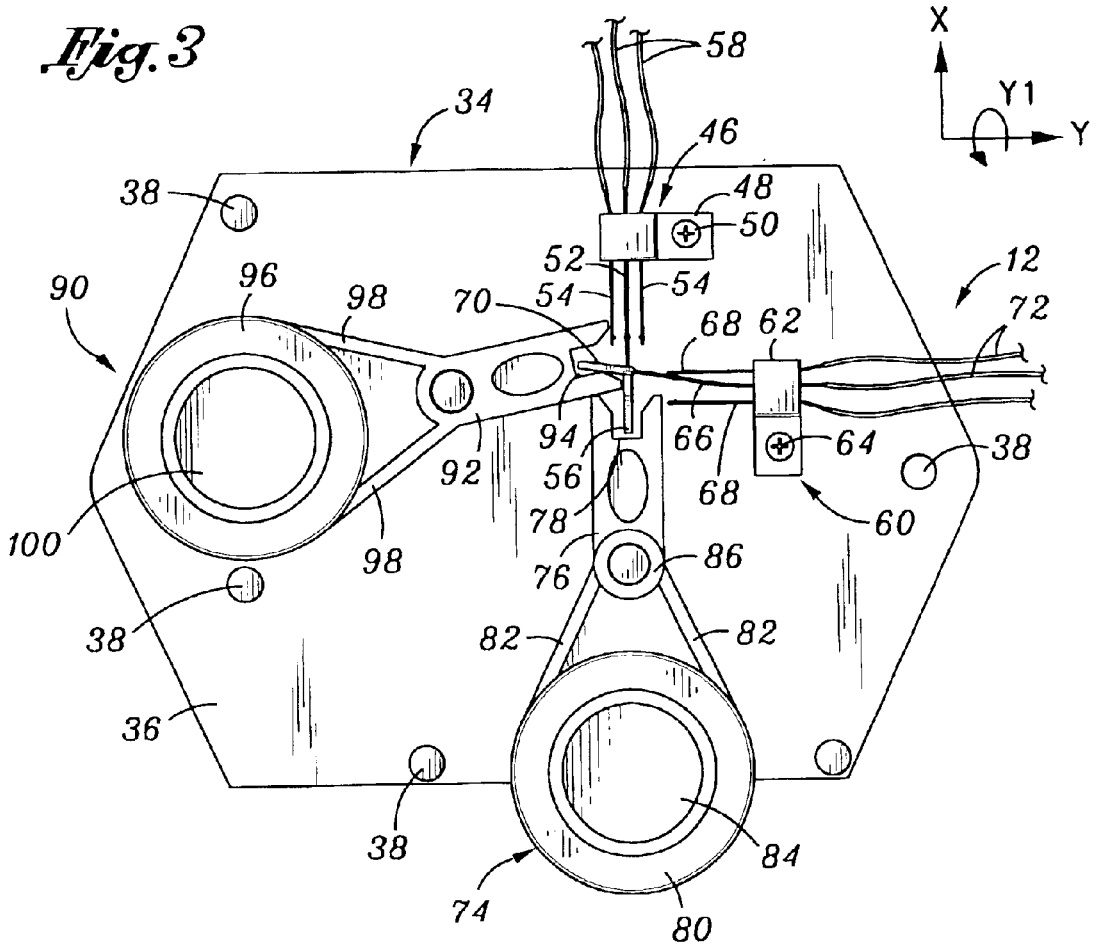
FIG. 3 is a top view of the sensor of the first embodiment, illustrating an exemplary manner in which one of the switches thereof is actuated to a trigger position by the movement of the sensor.
Figure 4:
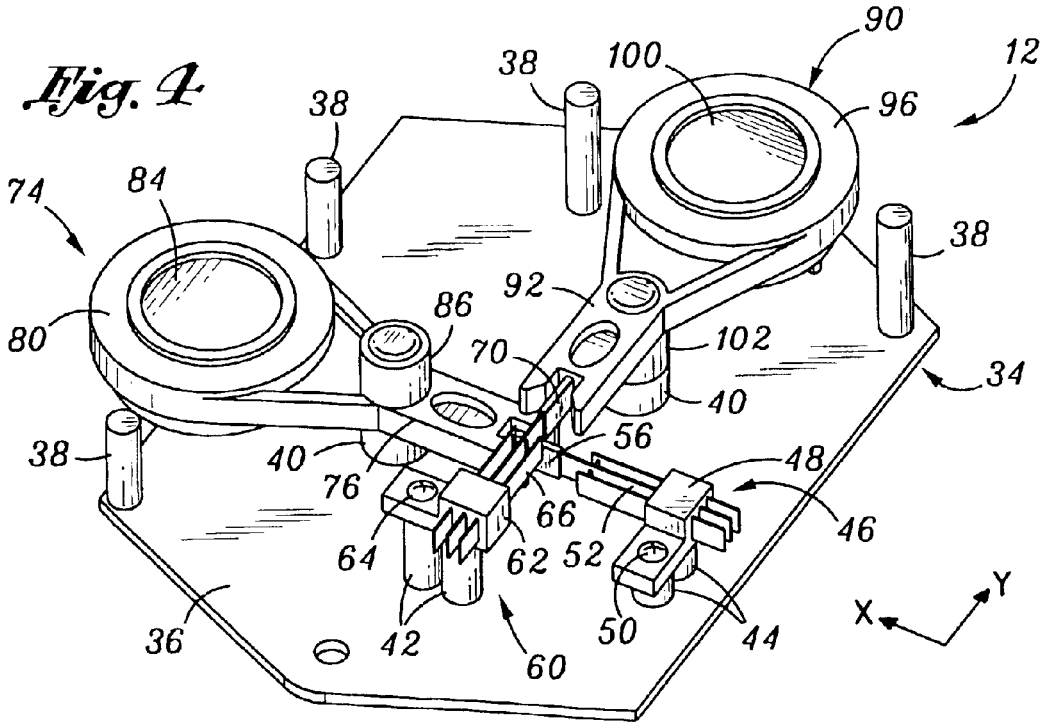
FIG. 4 is a perspective view of the sensor of the first embodiment.
Figure 5:
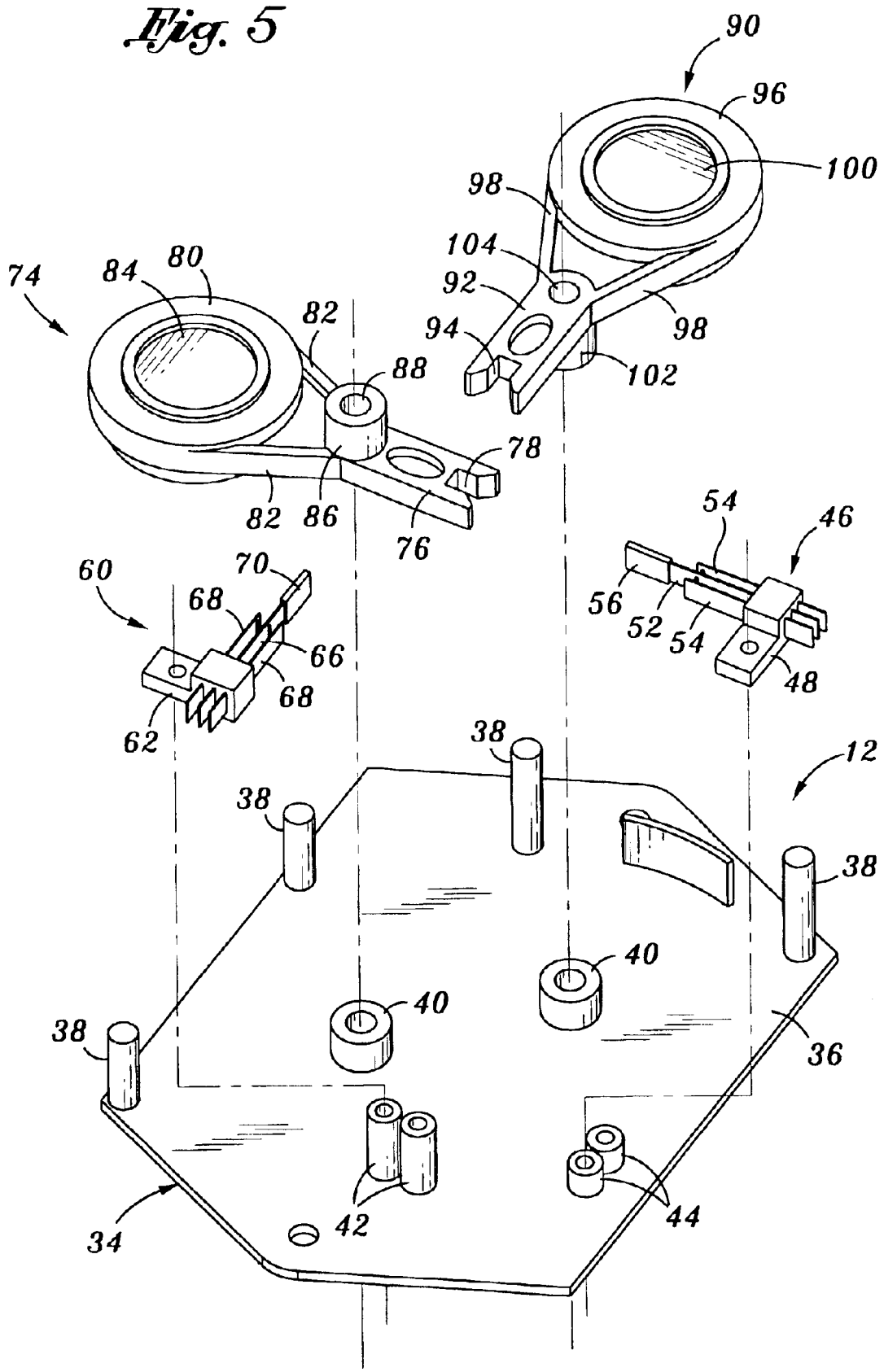
FIG. 5 is an exploded view of the sensor shown in FIG. 4.

Referring now to FIGS. 3–5, the sensor 12 of the first embodiment comprises a generally hexagonally configured base mount 34 which defines a first axis X and a second axis Y which extend in generally perpendicular relation to each other. The base mount 34 further defines a generally planar top surface 36 and includes a plurality of cylindrically configured pegs 38 which extend perpendicularly from the top surface 36 in generally parallel relation to each other. In addition to the pegs 38, the base mount 34 includes a first pair of tubular bosses 40, a second pair of tubular bosses 42, and a third pair of tubular bosses 44 which extend perpendicularly from the top surface 36 thereof in generally parallel relation to each other. The tubular bosses 40, 42, 44 of the first, second and third pairs, like the pegs 38, are integrally connected to the remainder of the base mount 34, and are used for reasons which will be discussed in more detail below. The entirety of the base mount 34 is preferably fabricated from a plastic material.

In addition to the base mount 34, the sensor 12 of the first embodiment comprises a first switch 46 which is attached to the base mount 34. More particularly, the first switch 46 comprises a switch body 48 which is positioned upon the tubular bosses 44 of the third pair, and secured thereto via the advancement of a fastener 50 such as a screw through the switch body 48 and into one of the tubular bosses 44 of the third pair. Attached to and extending perpendicularly from the switch body 48 are three (3) leaf contacts of the first switch 46, including a center leaf contact 52 which extends between and in spaced, generally parallel relation to a pair of outer leaf contacts 54. As is best seen in FIGS. 3 and 5, the center leaf contact 52 is of a length exceeding those of the outer leaf contacts 54 such that the distal end of the center leaf contact 52 protrudes beyond the distal ends of the outer leaf contacts 54. Attached to the distal end of the center leaf contact 52 is a protective sheath 56, the use of which will be discussed in more detail below. The center and outer leaf contacts 52, 54 are flexible and resilient, and fabricated from a metal material. Additionally, when the switch body 48 is positioned upon and secured to the tubular bosses 44 of the third pair, the center leaf contact 52 extends along the first axis X. The first switch 46 is electrically connected to the electronic circuitry 14 via wires 58 as shown in FIG. 3.

In addition to the first switch 46, the sensor 12 of the first embodiment comprises a second switch 60 which is identically configured to the first switch 46. The switch body 62 of the second switch 60 is positioned upon the tubular bosses 42 of the second pair, and secured thereto via the advancement of a fastener 64 such as a screw through the switch body 62 and into one of the tubular bosses 42 of the second pair. Extending perpendicularly from the switch body 62 is a center leaf contact 66 which is disposed between and in spaced, generally parallel relation to a pair of outer leaf contacts 68. The distal end of the center leaf contact 66, which protrudes beyond the distal ends of the outer leaf contacts 68, includes a protective sheath 70 attached thereto. The second switch 60 is attached to the tubular bosses 42 of the second pair such that the center leaf contact 66 extends along the second axis Y. As is best seen in FIGS. 4 and 5, the lengths of the tubular bosses 42 of the second pair exceed those of the tubular bosses 44 of the third pair such that when the switch bodies 48, 62 are attached to the tubular bosses 44, 42 of the third and second pairs, respectively, the protective sheath 70 attached to the distal end of the center leaf contact 66 of the second switch 60 is disposed immediately above the protective sheath 56 attached to the distal end of the center leaf contact 52 of the first switch 46. The second switch 60 is electrically connected to the electronic circuitry 14 via wires 72 as shown in FIG. 3.

The sensor 12 of the first embodiment further comprises a first actuator 74 which is pivotally connected to the base mount 34. As is best seen in FIG. 5, the first actuator 74 comprises a first section 76 having a recess or a notch 78 formed in one end thereof. In addition to the first section 76, the first actuator 74 includes an annular second section 80 which is integrally connected to the end of the first section 76 opposite that including the notch 78 formed therein via a pair of struts 82. Attached to the second section 80 is a circularly configured counter-weight 84. Additionally, formed on one side of the first section 76 at approximately the location whereat the struts 82 are connected thereto is a cylindrically configured hub portion 86. Extending axially through the hub portion 86 and the first section 76 is a bore 88.

As best seen in FIGS. 3–5, the first actuator 74 is pivotally connected to that tubular boss 40 of the first pair which is disposed closest to the tubular bosses 42 of the second pair. More particularly, the first section 76 is positioned upon such tubular boss 40 of the first pair such that the bore thereof is coaxially aligned with the bore 88 and the distal end of the center leaf contact 52 of the first switch 46 having the protective sheath 56 attached thereto is received into the notch 78. As shown in FIG. 4, a fastener such as a pivot pin is preferably advanced through the bore 88 and into the tubular boss 40 to complete the pivotal connection of the first actuator 74 to the base mount 34. The first actuator 74, when pivotally connected to the base mount 34, extends along the first axis X.

In addition to the first actuator 74, the sensor 12 of the first embodiment includes a second actuator 90 which is identically configured to the first actuator 74. In this respect, the second actuator 90 includes a first section 92 having a recess or notch 94 formed in one end thereof, with the end of the first section 92 opposite that including the notch 94 formed therein being integrally connected to an annular second section 96 via a pair of struts 98. Attached to the second section 96 is a circularly configured counter-weight 100, while formed on and extending from one side of the first section 92 is a cylindrically configured hub portion 102. Extending axially through the hub portion 102 and first section 92 is a bore 104.

The second actuator 90 is pivotally connected to the remaining tubular boss 40 of the first pair. As is most apparent from FIGS. 4 and 5, the second actuator 90 is "flipped over" relative to the first actuator 74 such that the hub portion 102, as opposed to the first section 92, directly contacts the corresponding tubular boss 40 of the first pair. Thus, when the second actuator 90 is pivotally connected to such tubular boss 40 by advancing a fastener such as a pivot pin through the bore 104 and the bore of the tubular boss 40 coaxially aligned therewith, the second actuator 90 will be elevated above the first actuator 74. Such increased elevation allows for the receipt of the center leaf contact 66 of the second switch 60 having the protective sheath 70 attached thereto into the notch 94 within the first section 92 of the second actuator 90. When pivotally connected to the base mount 34, the second actuator 90 extends along the second axis Y. Importantly, the lengths of the tubular bosses 40, 42, 44 of the first, second and third pairs and lengths of the hub portions 86, 102 are sized relative to each other such that when the first and second switches 46, 60 and first and second actuators 74, 90 are each attached to the base mount 34, the second switch 60 and corresponding second actuator 90 will extend along the second axis Y at a greater elevation relative to the top surface 36 of the base mount 34 than the first switch 46 and corresponding first actuator 74 extending along the first axis X. This elevational difference allows the center leaf contact 52 of the first switch 46 to pass underneath the center leaf contact 66 of the second switch 60. As will be recognized, these relative elevations and positions of the first and second switches 46, 60 and corresponding first and second actuators, 74, 90 relative to each other minimizes the profile of the sensor 12.

Having thus described the structural attributes of the sensor 12, its manner of operation will now be discussed with particular reference to FIGS. 3 and 4. As indicated above, the first axis X and the second axis Y extend in generally perpendicular relation to each other. When the sensor 12 is oriented such that the first and second axes X, Y each extend in generally parallel relation to a reference plane, both the first actuator 74 and the second actuator 90 assume a "home" position whereat the center leaf contact 52 of the first switch 46 does not contact either of the outer leaf contacts 54, and the center leaf contact 66 of the second switch 60 does not contact either of the outer leaf contacts 68. However, moving (e.g., turning, rotating) the sensor 12 to a position whereat at least one of the first and second axes X, Y extends in non-parallel relation to the reference plane will result in at least one of the first and second actuators 74, 90 pivoting from its home position to a "trigger" position whereat at least one of the center leaf contacts 52, 66 of the first and second switches 46, 60 will make contact with one of the outer leaf contacts 54, 68 of the corresponding pair.

For example, as seen in FIG. 3, assuming the first and second axes X, Y are initially oriented to extend in parallel relation to the reference plane, if the sensor 12 were to be rotated about the second axis Y in the direction Y1, the first axis X would be shifted to extend in non-parallel relation to the reference plane. Though the second axis Y continues to extend in parallel relation to the reference plane, the movement of the first axis X causes the force of gravity to act against the counter-weight 100 of the second actuator 90 which results in the counter-clockwise rotation of the second actuator 90 out of its home position into one of its trigger positions as viewed from the perspective shown in FIG. 3. More particularly, such rotation of the second actuator 90 causes the first section 92 to act against the center leaf contact 66 of the second switch 60 in a manner resiliently flexing the same into contact with one of the corresponding outer leaf contacts 68. The rotation of the sensor 12 in a direction opposite Y1 would result in the clockwise rotation of the second actuator 90 as viewed from the perspective shown in FIG. 3 as would cause the first section 92 to act against the center leaf contact 66 in a manner achieving contact with the other outer leaf contact 68 of the corresponding pair. Rotating the sensor 12 back to its original position would facilitate the return of the second actuator 90 to its home position whereat the center leaf contact 66 of the second switch 60 would no longer contact either of the corresponding outer leaf contacts 68 of the second switch 60.

The same relative rotations of the first actuator 74 resulting in the movement thereof from its home position to a trigger position whereat the center leaf contact 52 of the first switch 46 contacts one of the corresponding outer leaf contacts 54 would occur if the sensor 12 were to be rotated about the first axis X such that only the second axis Y is moved into non-parallel relation to the reference plane. Moreover, the first and second actuators 74, 90 may concurrently be moved to the trigger position by rotating, positioning or otherwise maneuvering the sensor 12 such that both the first and second axes X, Y extend in non-parallel relation to the reference plane at the same time.

Those of ordinary skill in the art will recognize that the first axis X along which the first switch 46 and corresponding first actuator 74 extend need not necessarily extend in generally perpendicular relation to the second axis Y along which the second switch 60 and corresponding second actuator 90 extend. In this respect, the first and second axes X, Y may simply extend in non-parallel relation to each other at an angle of separation less than ninety degrees (90°) or greater than ninety degrees (90°). Indeed, it is only necessary that the first and second axes X, Y do not extend in parallel relation to each other, though the extension thereof in perpendicular relation to each other is optimal for the performance of the sensor 12.

When the sensor 12 is incorporated into an interactive electronic device and electrical power is supplied thereto, no output signal is generated thereby when both the first and second actuators 74, 90 are in their home positions. The movement of at least one of the first and second actuators 74, 90 to one of its trigger positions results in at least one output signal being generated by the sensor 12. Due to each of the first and second switches 46, 60 including three (3) leaf contacts and the first and second actuators 74, 90 extending along two (2) different axes which preferably extend in generally perpendicular relation to each other, the total number of different output signals which may generated by the sensor 12 is three (the number of leaf contacts in each switch) to the second power (representing the total number of axes) less one (representing the absence of an output signal when the first and second actuators 74, 90 are in their home positions) for a total of eight (8) different output signals. As indicated above, each of these output signals will differ depending upon the level/position or orientation of the sensor 12, and hence the interactive electronic device in which it is incorporated, relative to the reference plane. Due to the electrical connection of the sensor 12 to the electronic circuitry 14, each of these output signals is communicated to the electronic circuitry 14.

As indicated above, the sensor 12, switches associated with the front door 20 and buttons 24, contact regions 26, on/off switch 28, speaker 30, and LED's of the spaceship 10 are all in electrical communication with the electronic circuitry 14 which receives its power from the batteries within the battery compartment 32. The electronic circuitry 14 shown in FIG. 9 is operative to facilitate the production of audible outputs from the speaker 30 and visual outputs from the LED's alone and/or in combination which correspond to the absence of an output signal and to respective ones of the output signals generated by the sensor 12 and transmitted thereto. In this respect, it is contemplated that the electronic circuitry 14 will be programmed to have a default output responding to the absence of an output signal being generated by the sensor 12, with the default output resulting in the transmission of audible and/or visual outputs. The electronic circuitry 14 also facilitates the production of these visual and/or audible outputs as a result of the opening and closing of the front door 20, depression of any one of the buttons 24, and finger-tip contact against any one of the contact regions 26. Thus, the spaceship 12 (or any other interactive electronic toy) in which the sensor 12 and associated electronic circuitry 14 are incorporated is capable of producing a variety of differing visual and/or audible effects or functions, many of which are responsive to changes in the level/position or orientation of the spaceship 10 relative to a reference plane.

It is contemplated that the electronic circuitry 14 will be programmable, and particularly programmed to produce certain visual and/or audible effects, depending upon which particular switch is actuated and/or which output signals are transmitted thereto from the sensor 12. It is further contemplated that the electronic circuitry 14 may be programmed to produce a selected effect upon a prescribed sequence of supplemental output signals being transmitted thereto from the sensor 12. For example, in the context of the spaceship 10, the electronic circuitry 14 may be programmed to facilitate the production of a selected visual and/or audible output if the nose of the spaceship 10 is first tilted up, then immediately thereafter tilted down.

Figure 10:
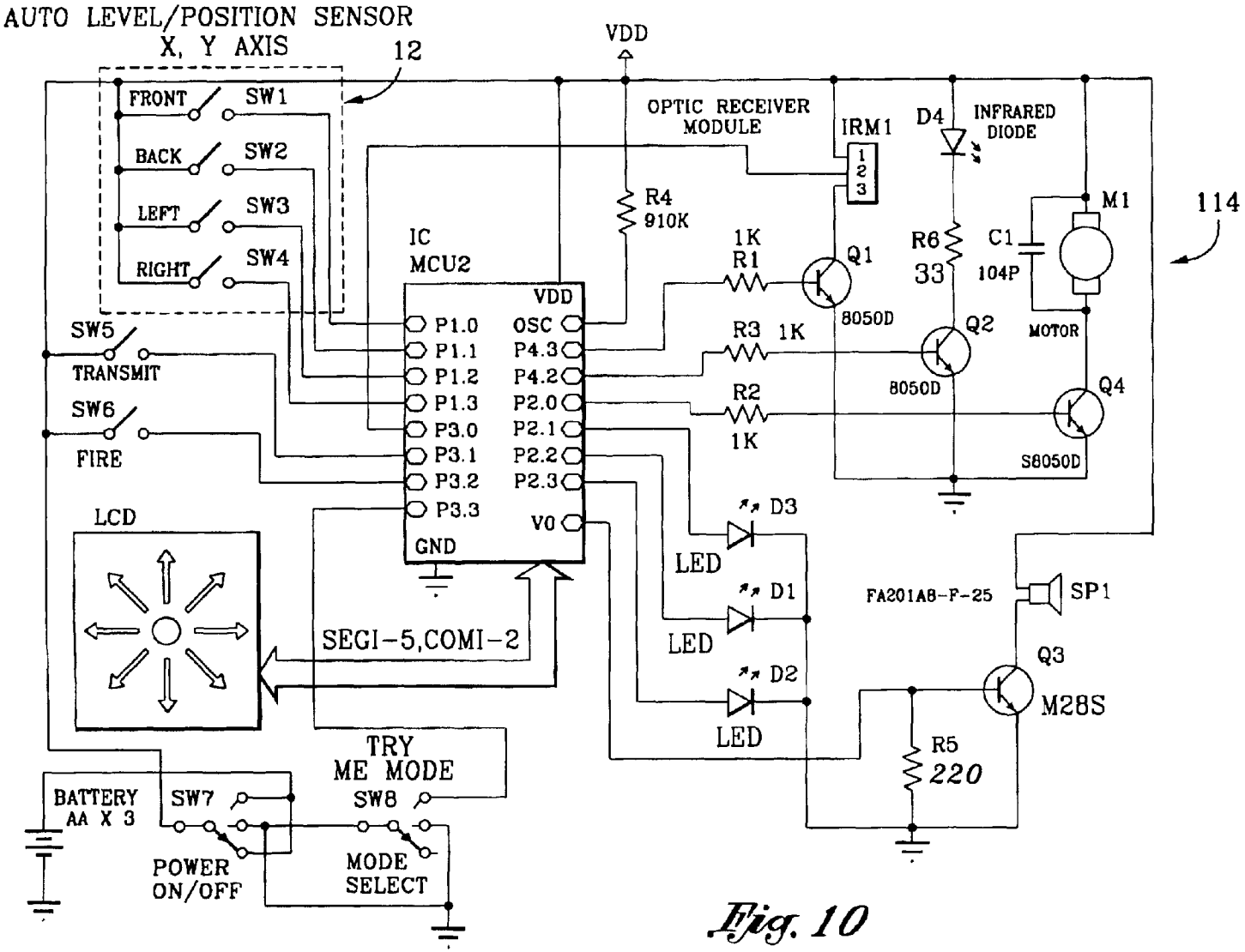
FIG. 10 is a schematic of exemplary electronic circuitry which may be used in conjunction with the sensor of the first embodiment for incorporation into an interactive electronic joystick remote controller.

As also indicated above, the sensor 12 and associated electronic circuitry 14 may be incorporated into an interactive electronic device other than for a toy such as the spaceship 10. Schematically illustrated in FIG. 10 is electronic circuitry 114 which may be employed as an alternative to the electronic circuitry 14 for use in conjunction with the sensor 12 when the sensor 12 is incorporated into an interactive electronic joystick remote controller. This alternative electronic circuitry 114 is designed to facilitate the production of the visual and/or audible outputs as is the case when the sensor 12 is incorporated into an interactive electronic toy or game such as the spaceship 10. The electronic circuitry 114 is also operative to simultaneously translate the absence of an output signal or the output signals generated by the sensor 12 into infrared signals which may be transmitted from the joystick at differing frequencies, with each particular frequency corresponding to a respective output signal. The infrared signals produced by the movement of the joystick remote controller relative to the reference plane may be simultaneously transmitted to another device (e.g., a toy) to facilitate the control and operation thereof in a prescribed manner. As opposed to the joystick remote controller transmitting infrared signals, the electronic circuitry 114 may be configured to transmit radio signals of differing frequencies, microwave signals of differing frequencies, or any combinations thereof.

Figure 11:
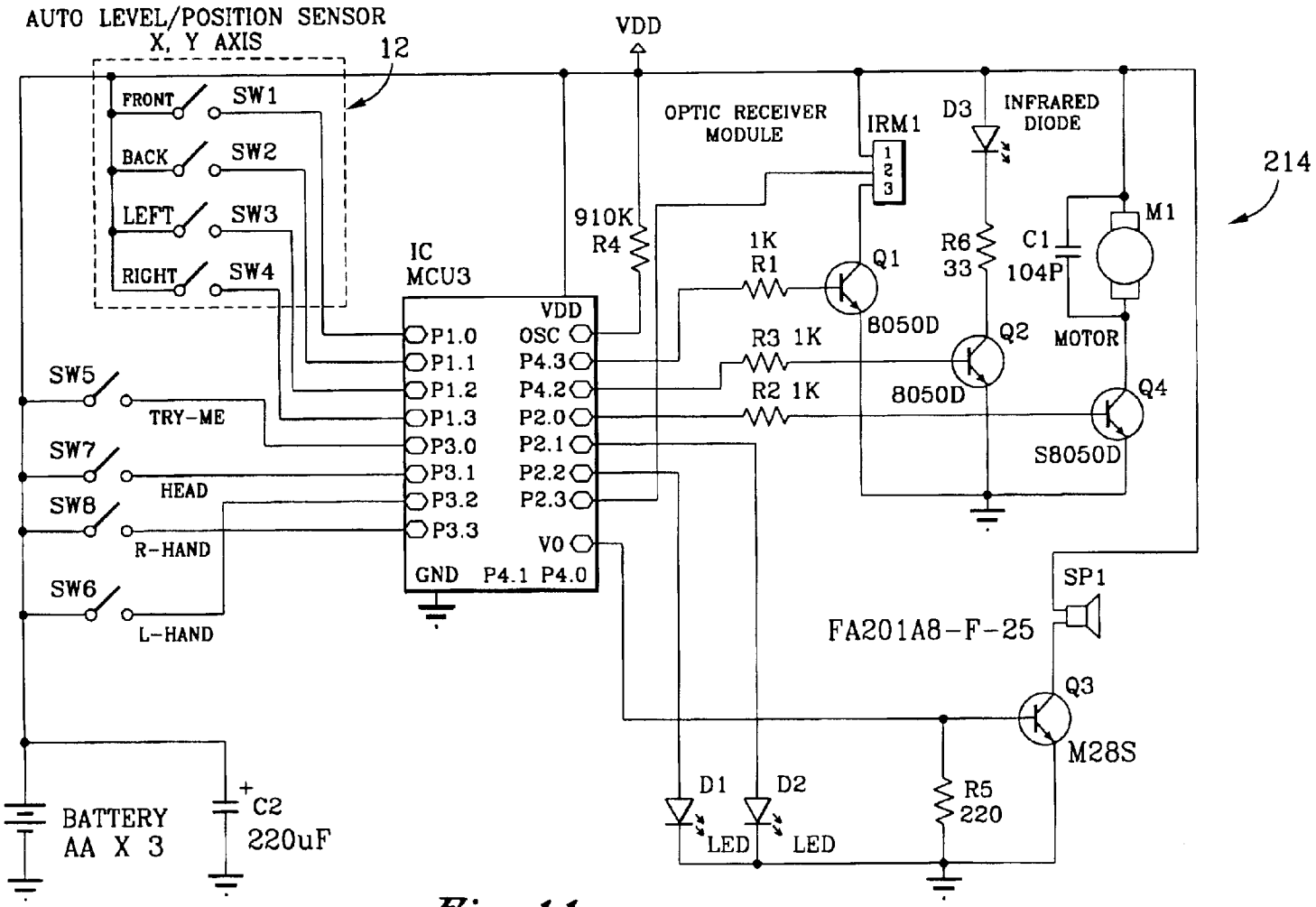
FIG. 11 is a schematic of exemplary electronic circuitry which may be used in conjunction with the sensor of the first embodiment for incorporation into an interactive electronic doll.

Referring now to FIG. 11, schematically illustrated is electronic circuitry 214 which is a further variation of the electronic circuitry 14, and is adapted for use in conjunction with the sensor 12 when the same is incorporated into an interactive electronic doll. The electronic circuitry 214 may be used to facilitate the production of various visual and/or audible outputs from the doll corresponding to particular movements thereof relative to the reference plane, and/or to cause the doll to transmit infrared, radio, or microwave signals of differing frequencies to another doll or toy in the above-described manner to facilitate the control and operation thereof. The frequencies of the infrared, radio, or microwave signals transmitted by the doll will correspond the absence of an output signal and to respective ones of the output signals generated by the sensor 12 and transmitted to the electronic circuitry 214.

Figure 6:
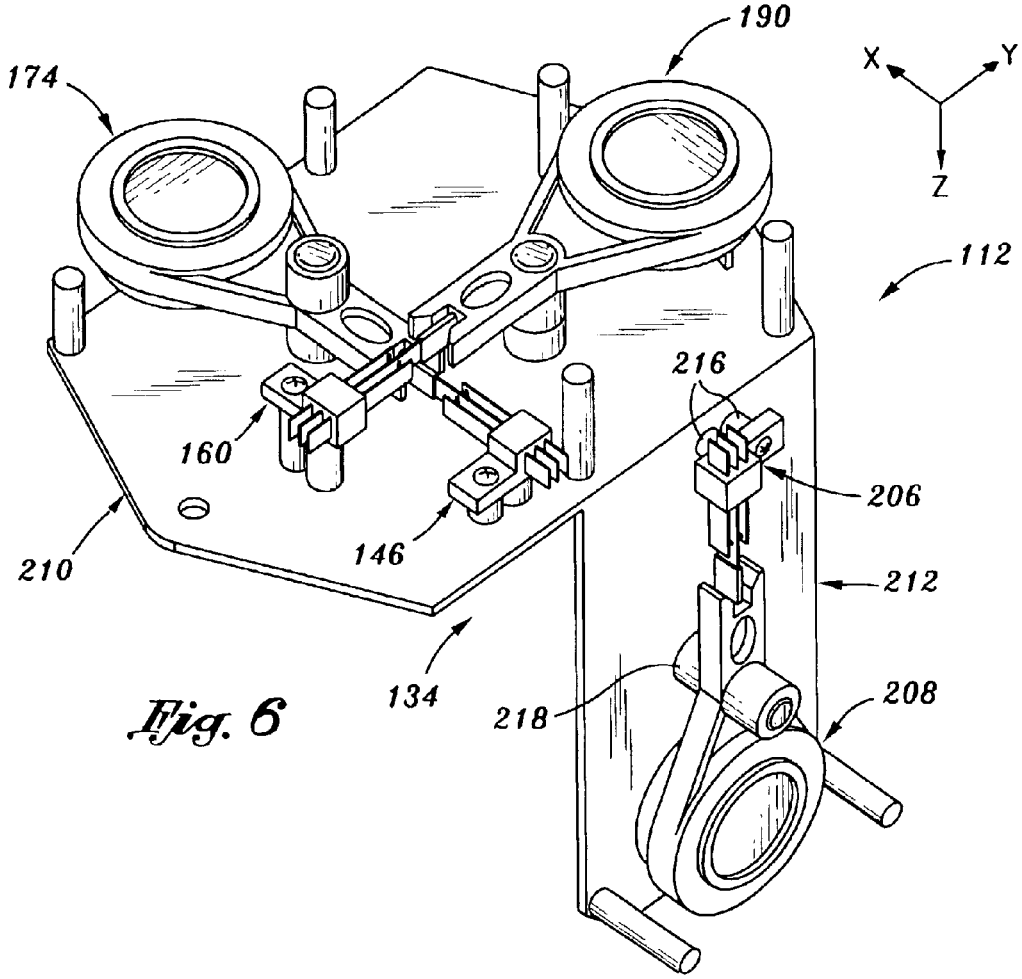
FIG. 6 is a perspective view of a sensor constructed in accordance with a second embodiment of the present invention.

Referring now to FIG. 6, there is shown the sensor 112 constructed in accordance with the second embodiment of the present invention. The sensor 112 essentially comprises the aforementioned sensor 12 with the addition of a third switch 206 and a third actuator 208 which are cooperatively engagable to each other and extend along a third axis Z which extends in generally perpendicular relation to the first and second axes X,Y.

The sensor 112 comprises a base mount 134 including a primary section 210 and a secondary section 212. The secondary section 212 extends generally perpendicularly relative to the primary section 210, with the primary section 210 defining the first axis X and the second axis Y which extend in generally perpendicular relation to each other. The primary section 210 of the base mount 134 is identically configured to the base mount 34. Attached to the primary section 210 is a first switch 146 and a second switch 160. The first and second switches 146, 160 are identically configured to each other, and to the first and second switches 46, 60 described in relation to the sensor 12. Additionally, pivotally connected to the primary section 210 is a first actuator 174 and a second actuator 190 which are identically configured to each other and to the first and second actuators 74, 90 described in relation to the sensor 12. The first switch 146 and first actuator 174 extend along the first axis X and are cooperatively engagable to each other in the same manner previously described in relation to the first switch 46 and first actuator 74 of the sensor 12. Similarly, the second switch 160 and second actuator 190 extend along the second axis Y and are cooperatively engagable to each other in the same manner as previously described in relation to the second switch 60 and second actuator 90 of the sensor 12.

The third switch 206 is itself identically configured to the first and second switches 146, 160, and is positioned upon and attached to a pair of tubular bosses 216 formed on and extending outwardly from the secondary section 212 of the base mount 134. The tubular bosses 216 are sized and configured identically to the tubular bosses 44 of the third pair described above in relation to the sensor 12. The third actuator 208 is identically configured to the first and second actuators 174, 190, and hence the first and second actuators 74, 90 of the sensor 12. The manner in which the third actuator 208 is cooperatively engagable to the third switch 206 is identical to that previously described in relation to the first and second switches 46, 60 and first and second actuators 74, 90 of the sensor 12 of the first embodiment. As is seen in FIG. 6, the secondary section 212 of the base mount 134 also includes a cylindrically configured tubular boss 218 protruding outwardly therefrom which is identically configured to one of the above-described tubular bosses 40 of the first pair in the sensor 12. The third actuator 208 is pivotally connected to the tubular boss 218 in the same manner previously described in relation to the pivotal connection of the first actuator 74 to one of the tubular bosses 40 of the first pair.

As will be recognized by those of ordinary skill in the art, the sensor 112 of the second embodiment, due to its inclusion of the third switch 206 and third actuator 208 extending along the third axis Z, is capable of producing a larger number of output signals as compared to the sensor 12 of the first embodiment. The sensor 112 of the second embodiment does not generate an output signal when the first axis X and second axis Y each extend in generally parallel relation to a reference plane, and the third axis Z extends in generally perpendicular relation to such reference plane. When the first, second and third axes X, Y, Z are disposed in these particular orientations, the first, second and third actuators 174, 190, 208 will each be disposed in their home position. Because each of the first, second and third switches 146, 160, 206 includes three (3) leaf contacts and the first, second and third actuators 174, 190, 208 extend along three different axes, the sensor 112 of the second embodiment is capable of producing three (representing the number of leaf contacts in each of the switches) to the third power (representing the total number of axes) output signals less one (representing the absence of an output signal when each of the actuators is in its home position), for a total of twenty-six (26) output signals. Thus, the addition of the third switch 206 and third actuator 208 extending along the third axis Z essentially triples the number of output signals that may be produced by the sensor 112 in comparison to the sensor 12 of the first embodiment. Those of ordinary skill in the art will recognize that the third axis Z need not necessarily extend in generally perpendicular relation to the first and second axes X, Y, but rather may simply extend in non-parallel relation thereto, though it is preferable that the angle of separation be approximately ninety degrees (90°).

Figure 12:
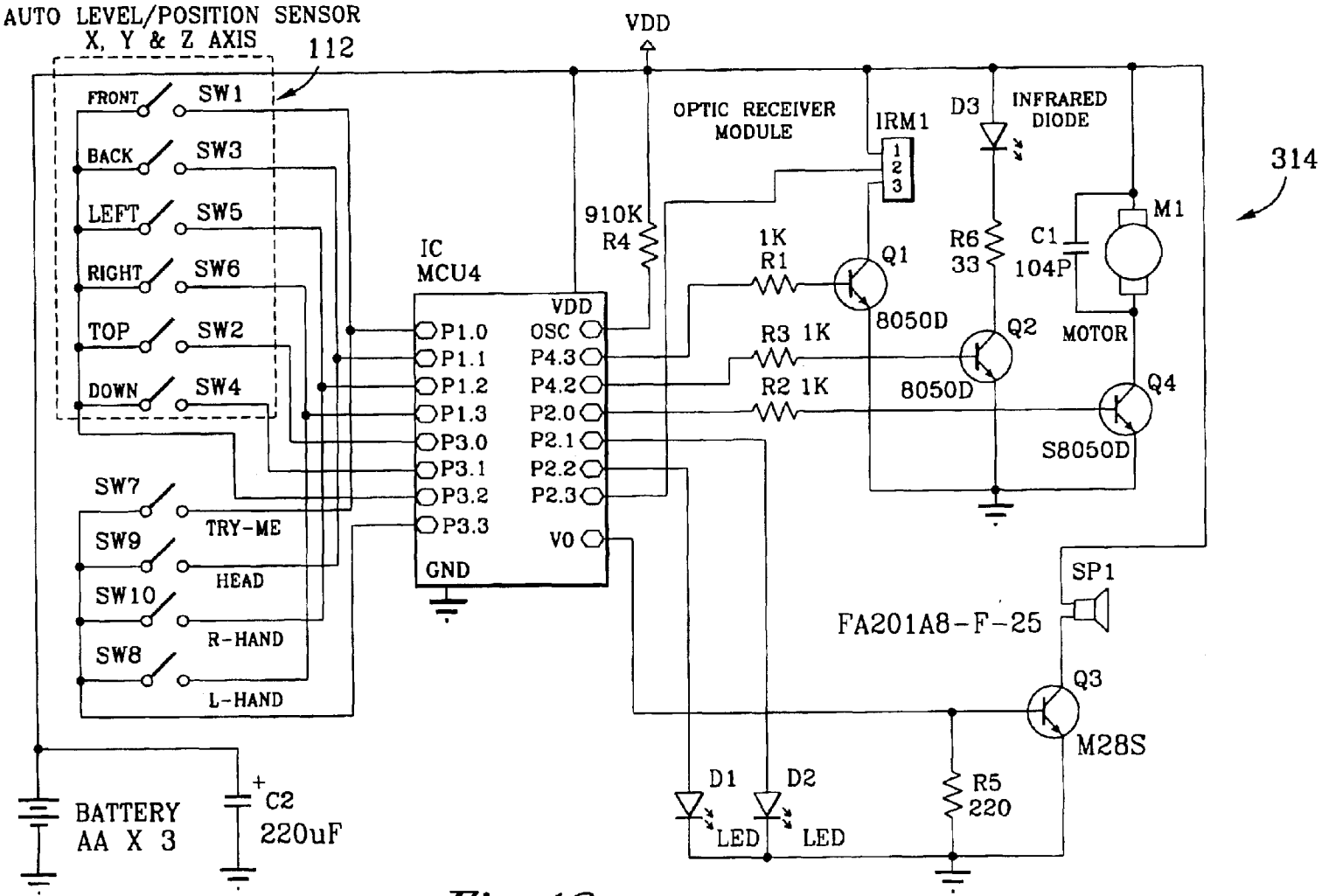
FIG. 12 is a schematic of exemplary electronic circuitry which may be used in conjunction with the sensor of the second embodiment for incorporation into an interactive electronic doll.

Referring now to FIG. 12, there is schematically illustrated electronic circuitry 314 which may be used in conjunction with the sensor 112 of the second embodiment when the same is incorporated into an interactive electronic device, and more particularly an interactive doll. The electronic circuitry 314 is similar in functional capability to the electronic circuitry 214 discussed above, but is modified so as to accept the greater number of output signals from the three-axis sensor 112 of the second embodiment. The above-described electronic circuitry 214, though also being intended for use in an interactive doll, is configured to accept the lesser number of output signals as generated by the two-axis sensor 12 of the first embodiment.

Figure 7:
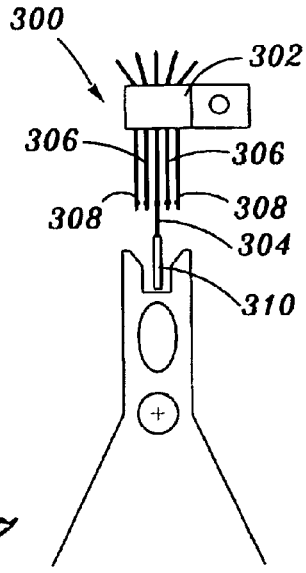
FIG. 7 is a top view of an alternative embodiment of a switch which may be incorporated into the sensors of either the first or second embodiments.
Figure 8:
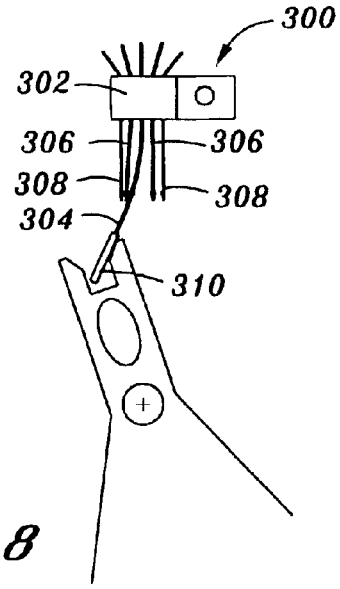
FIG. 8 is a top view of the switch shown in FIG. 7, illustrating an exemplary manner in which such switch is actuated by the movement of the sensor.

Referring now to FIGS. 7 and 8, there is depicted a switch 300 which may be incorporated into the sensor 12 of the first embodiment as an alternative to each of the first and second switches 46, 60, and in the sensor 112 of the second embodiment as an alternative to each of the first, second and third switches 146, 160, 206. The switch 300 includes a switch body 302 which is identically configured to the switch bodies 48, 62 as described above in relation to the sensor 12. However, rather than including only three leaf contacts, the switch 300 includes five (5) leaf contacts including a center leaf contact 304 which extends between and in spaced, generally parallel relation to a pair of inner leaf contacts 306 and a pair of outer leaf contacts 308. The length of the center leaf contact 304 exceeds those of the inner and outer leaf contacts 306, 308, such that the distal end of the center leaf contact 304 protrudes beyond the distal ends of the inner and outer leaf contact 306, 308. Attached to the distal end of the center leaf contact 304 is a protective sheath 310.

As seen in FIG. 8, either the first or second actuator 74, 90 of the sensor 12 or any one the first, second and third actuators 174, 190, 208 of the sensor 112 will act against the center leaf contact 304 in a similar manner to that described in relation to the three leaf contact switches. However, a slight amount of rotation of one of the aforementioned actuators from its home position to its trigger position will result in the center leaf contact 304 of the switch 300 being placed into contact with only one of the corresponding pair of inner leaf contacts 306. A greater amount and/or force of rotation will result in the inner leaf contact 306 of the pair against which the center leaf contact 304 is abutted to itself be flexed into contact with the outer leaf contact 308 of the corresponding pair which is disposed adjacent thereto.

Figure 13:
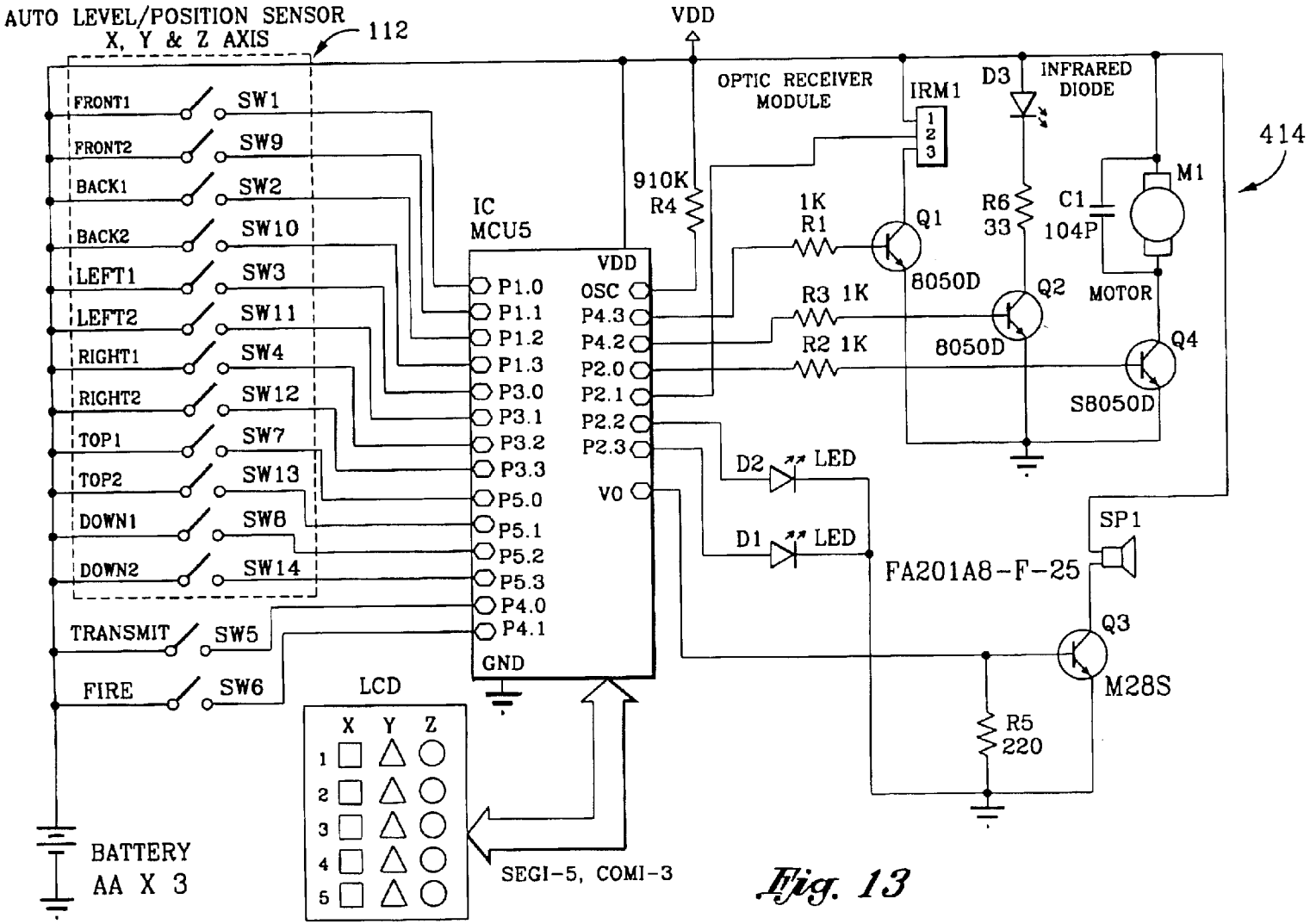
FIG. 13 is a schematic of exemplary electronic circuitry which may be used in conjunction with the sensor of the second embodiment as modified to include the alternative switch shown in FIG. 7 for incorporation into an interactive electronic joystick remote controller.

Based on the foregoing, the inclusion of the switches 300 in the sensor 12 as an alternative to the first and second switches 46, 60 imparts to the sensor 12 the ability to generate five (representing the number of leaf contacts in each switch) to the second power (representing the total number of axes) output signals less one (representing the absence of an output signal when each of the actuators is in its home position), for a total of twenty-four (24), output signals. The substitution of the switches 300 for the first, second and third switches 146, 160, 206 of the sensor 112 imparts to the sensor 112 the ability to generate five (representing the number of leaf contacts in each of the switches) to the third power (representing the total number of axes) output signals less one (representing the absence of an output signal when the actuators are each in their home positions), for a total of one hundred twenty-four (124) output signals. FIG. 13 schematically illustrates electronic circuitry 414 which may be used in conjunction with the sensor 112 of the second embodiment as outfitted to include the switches 300 in substitution for each of the first, second and third switches 146, 160, 206. The electronic circuitry 414 is specifically configured for use in conjunction with the sensor 112/switch 300 combination when the same is incorporated into the joystick remote controller.

Figure 14A:
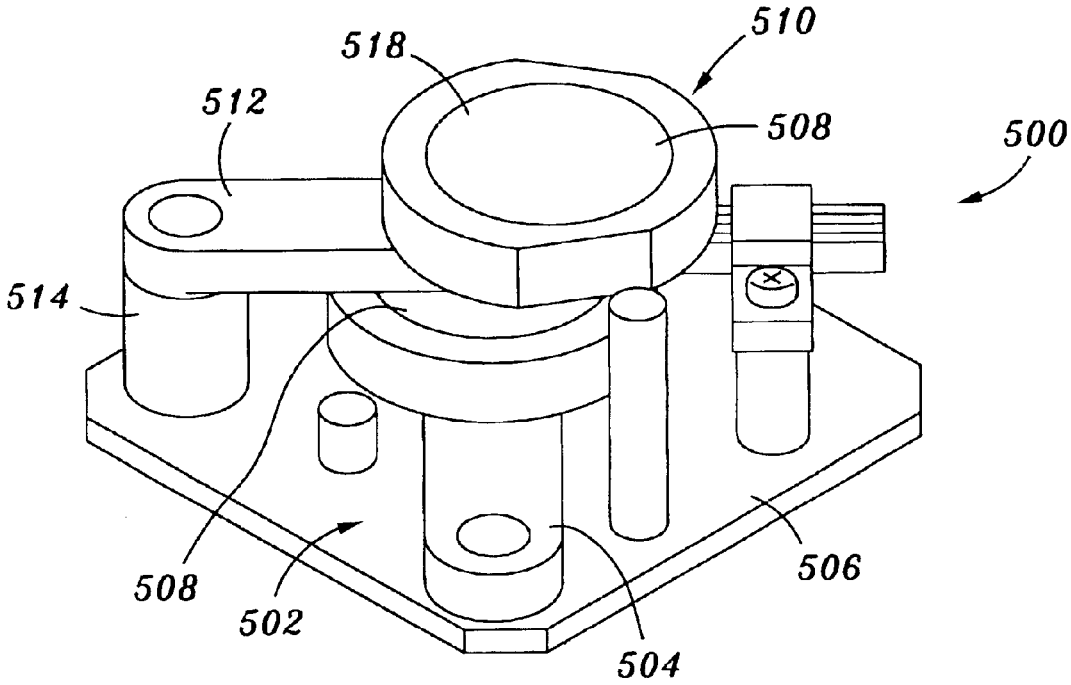
FIG. 14*a* is a perspective view of a sensor constructed in accordance with a third embodiment of the present invention.

Those of ordinary skill in the art will recognize that the sensor 12 and sensor 112 may be modified to have differing configurations without departing from the spirit and scope of the present invention. For example, referring now to FIGS. 14*a* and 14*b*, there is depicted a sensor 500 comprising a first actuator 502 having a fist section 504, one end of which is pivotally connected to a base plate 506, with the opposite end of the first section 504 having a notch formed therein. In addition to the first section 504, the first actuator 502 includes a counter-weight 508 which is attached to the first section 504 immediately above the notch formed in the end thereof opposite that pivotally connected to the base plate 506.

Figure 14B:
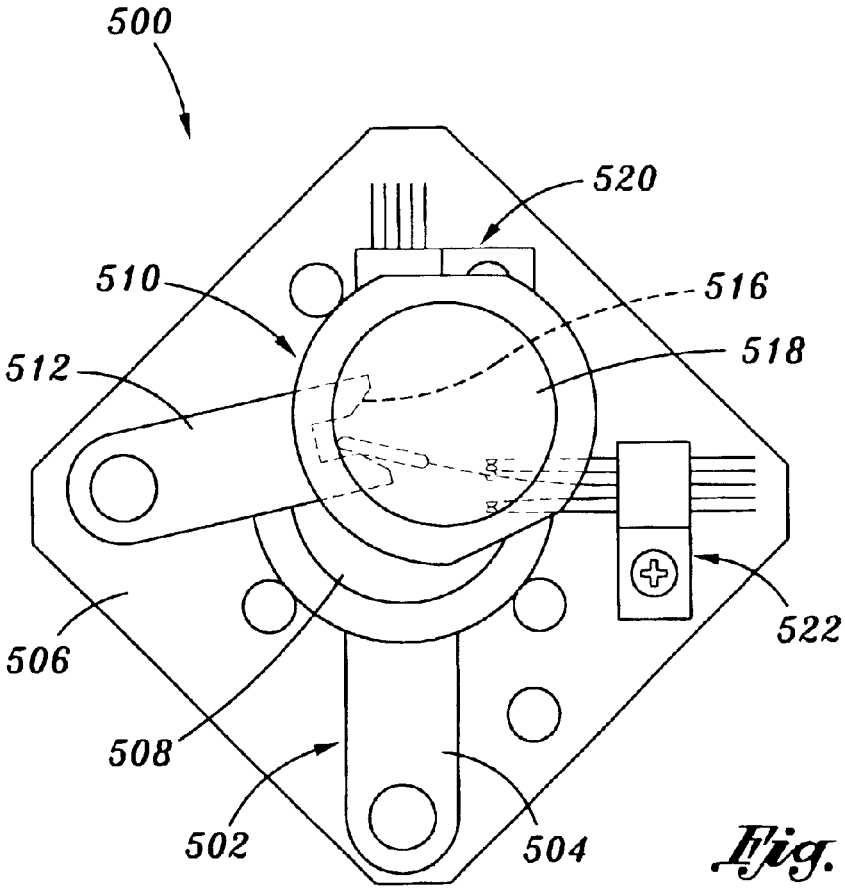
FIG. 14*b* is a top view of the sensor of the third embodiment shown in FIG. 14*a*, illustrating in phantom one of the actuators thereof in its trigger position.

The sensor 500 also includes a second actuator 510 which is identically configured to the first actuator 502. In this respect, the second actuator 510 includes a first section 512 having one end which is pivotally connected to a tubular boss 514 extending perpendicularly upward from the top surface of the base plate 506. The opposite end of the first section 512 includes a notch 516 formed therein. Attached to the first section 512 immediately above the notch 516 is a counter-weight 518 of the second actuator 510. The first actuator 502 is cooperatively engaged to a first switch 520, with the second actuator 510 being cooperatively engaged to a second switch 522. The first and second switches 520, 522 are each attached to the base plate 506, and are identically configured to the above described first and second switches 46, 60. Additionally, the manner in which the first sections 504, 512 of the first and second actuators 502, 510 cooperatively engage respective ones of the switches 520, 522 occurs in the same manner described above through the receipt of the protective sheaths disposed on the ends of the center leaf contacts of the switches 520, 522 into respective ones of the notches within the first sections 504, 512. As is best seen in FIG. 14*b*, the first actuator 502 and accompanying first switch 520 and second actuator 510 and accompanying second switch 522 extend along respective axes which extend in generally perpendicular relation to each other when the first and second actuators 502, 510 are each in their home position. In the sensor 500, the construction thereof such that the counter-weights 508, 518 are disposed above the notches in respective ones of the first sections 504, 512 reduces the length of the first and second actuators 502, 510 by approximately one-half in comparison to those discussed above in relation to the prior embodiments of the present sensor.

Figure 15A:
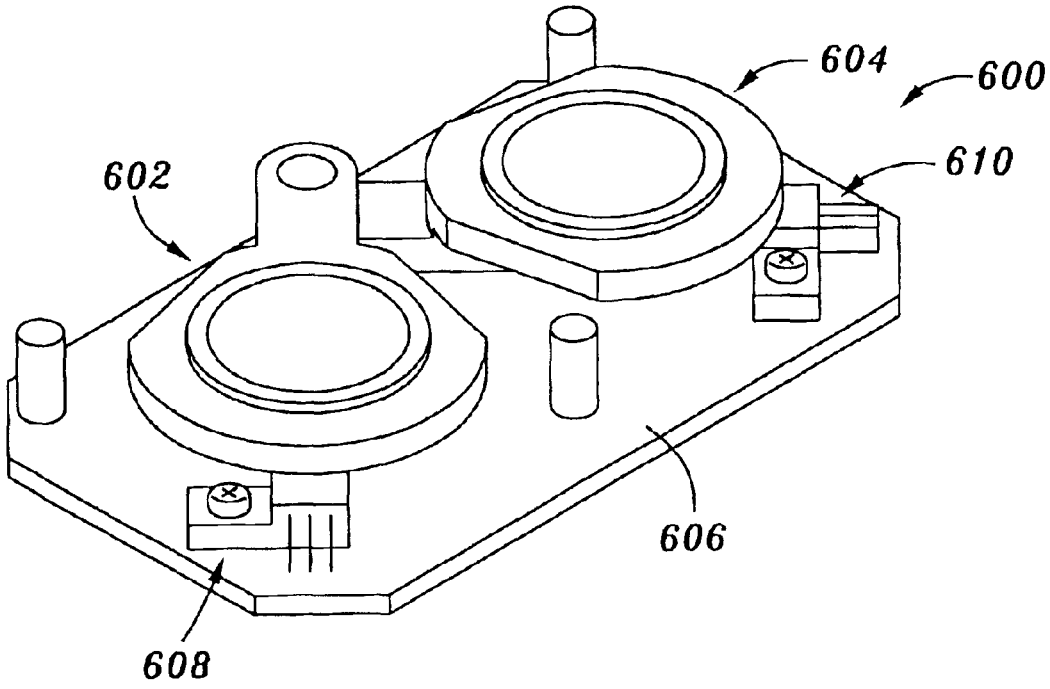
FIG. 15*a* is a perspective view of a sensor constructed in accordance with a fourth embodiment of the present invention.
Figure 15B:
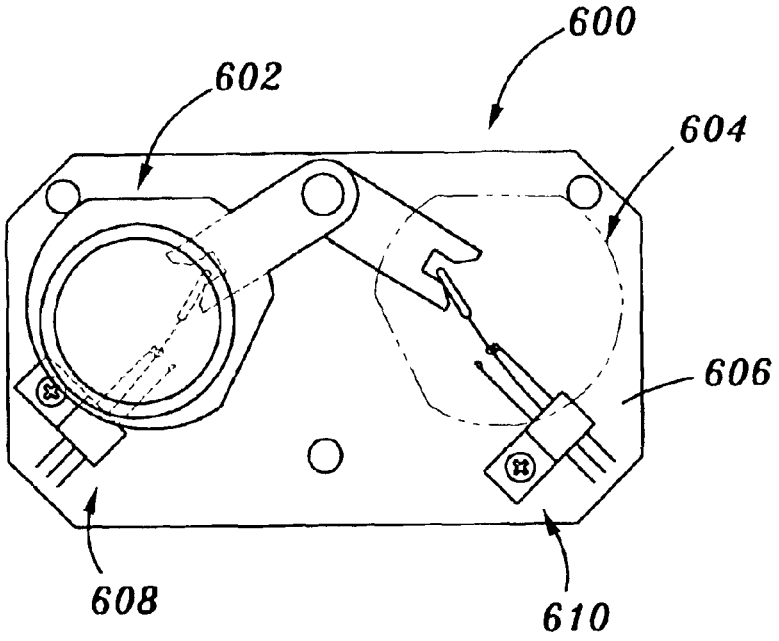
FIG. 15*b* is a top view of the sensor of the fourth embodiment shown in FIG. 15*a*, illustrating each of the actuators thereof in their trigger positions.

Referring now to FIGS. 15*a* and 15*b*, there is depicted a sensor 600 comprising first and second actuators 602, 604 which are similarly configured to the first and second actuators 502, 510 described in relation to the sensor 500. The first and second actuators 602, 604 are pivotally connected to a base plate 606 of the sensor 600 at a common pivot point, and cooperatively engaged to respective ones of first and second switches 608, 610 of the sensor 600 which are each attached to the base plate 606 and identically configured to the switches 520, 522 described in relation to the sensor 500. When the first and second actuators 602, 604 are each in their home position, they and their corresponding switches 608, 610 extend along respective axes which are oriented in generally perpendicular relation to each other. Each of the first and second actuators 602, 604 is cooperatively engaged to a respective one of the first and second switches 608, 610 in a manner similar to that previously described in relation to the cooperative engagement of the first and second actuators 502, 510 of the sensor 500 to respective ones of the first and second switches 520, 522 thereof.

The modifications described in relation to the sensors 500, 600 are for purposes of minimizing the overall profile thereof. In the sensor 500, the profile is minimized by the reduced sizes of the first and second actuators 502, 510 thereof. In the sensor 600, the first and second actuators 602, 604 are also of a smaller size, with the profile of the sensor 600 also being reduced by the first and second actuators 602, 604 sharing a common pivot point. Those of ordinary skill in the art will recognize that the modifications reflected in the sensors 500, 600 are not exhaustive of the manners in which the actuators and switches of the sensor may be reconfigured for purposes of minimizing the overall profile thereof. As will be recognized, the ultimate configuration of the sensor will largely be dependant upon the configuration or spacial allotment of the particular interactive electronic device in which it is to be incorporated.

Figure 16:
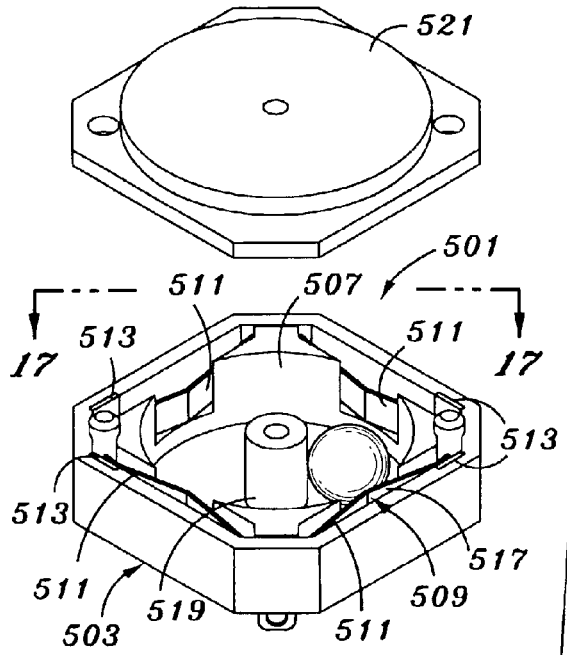
FIG. 16 is a top perspective view of a sensor constructed in accordance with a fifth embodiment of the present invention, illustrating the cover plate as separated from the remainder thereof.
Figure 17:
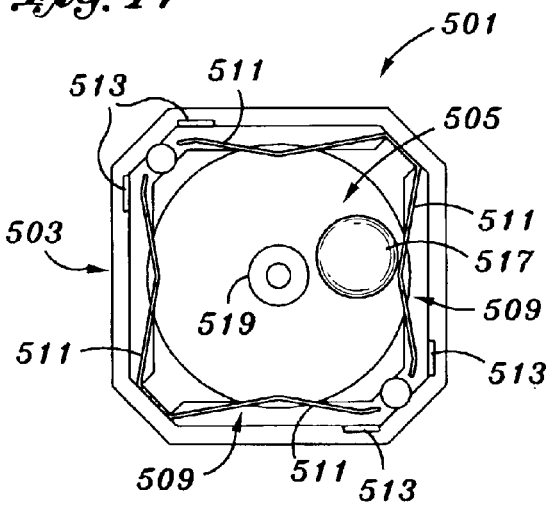
FIG. 17 is a top plan view of the sensor of the fifth embodiment shown in FIG. 16, not including the cover plate.
Figure 18:
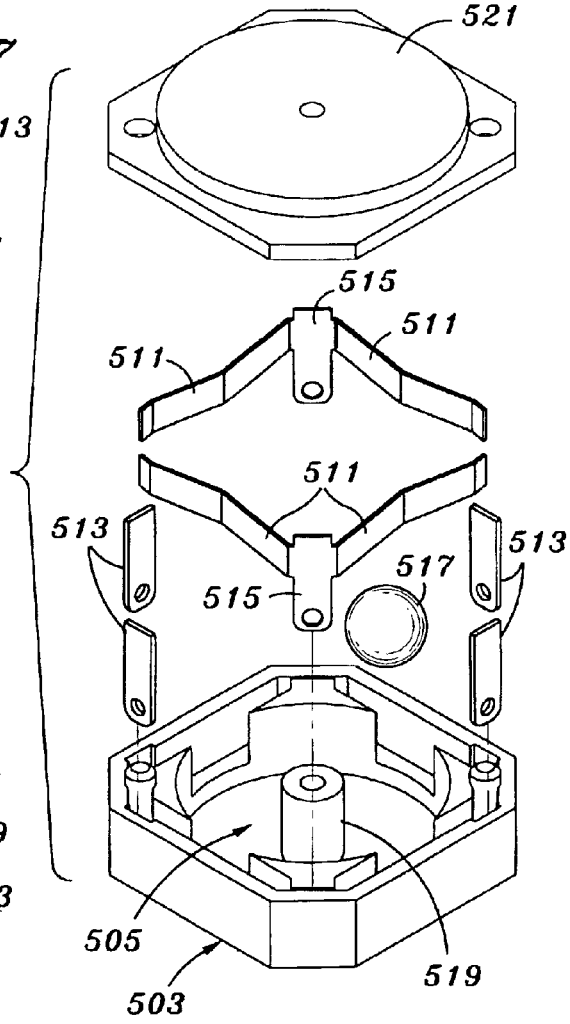
FIG. 18 is an exploded view of the sensor of the fifth embodiment.

Referring now to FIGS. 16–18, there is depicted a sensor 501 constructed in accordance with a fifth embodiment of the present invention. The sensor 501 is also intended for use in an interactive electronic device, and comprises a base member 503 having a recess 505 formed therein. The recess 505 is partially defined by a peripheral wall 507 of the base member 503. In the sensor 501, the peripheral wall 507 is preferably circularly configured, thus resulting in the recess 505 being circularly configured as well. Extending axially with the recess 505 is a cylindrically configured central post 519 of the base member 503. Disposed within the peripheral wall 507 of the base member 503 are four switches 509 which are preferably spaced at intervals of approximately ninety degrees.

Each of the switches 509 preferably comprises a resilient primary lead 511 which is disposed within the peripheral wall 507 and is movable between flexed and unflexed positions. In addition to the primary lead 511, each of the switches 509 includes a secondary lead 513 which is disposed within the base member 503. As is best seen in FIG. 18, one end of the primary lead 511 of each pair is integrally connected to a lead mount 515. The lead mounts 515 are insertable into respective ones of an opposite pair of corners of the base member 503. The primary leads 511 are configured such that upon the insertion of the lead mounts 515 into the base member 503, portions of the primary leads 511 protrude into the interior of the recess 505 via respective openings formed within the peripheral wall 507, as is best shown in FIG. 17. The secondary leads 513 are inserted in pairs into respective ones of the remaining two opposite corners of the base member 503 not including the lead mounts 515 inserted thereinto. Upon the insertion of the lead mounts 515 and secondary leads 513 into the base member 503 in the above-described manner, those ends of the primary leads 511 opposite the ends connected to the lead mounts 515 are disposed in spaced relation to respective ones of the secondary leads 513.

The sensor 501 of the fifth embodiment further comprises a spherically shaped trigger ball 517 which is disposed within the recess 505 and is freely movable about the peripheral wall 507. As it moves within the recess 505, the trigger ball 517 is maintained along the peripheral wall 507 by the post 519 of the base member 503.

Additionally, the trigger ball 517 is maintained within the recess 505 by a cover plate 521 which is attached to the base member 503 via fasteners such as screws.

The sensor 501 of the fifth embodiment is operative to generate at least two different states corresponding to respective positions of the sensor 501 relative to a reference plane, with the movement of the sensor 501 relative to the reference plane facilitating the movement of the trigger ball 517 within the recess 505. More particularly, the sensor is operative to generate a low state when the trigger ball 517 is not in contact with any of the switches 509, and in particular those portions of the primary leads 511 which protrude into the interior of the recess 505. The sensor 501 is further operative to generate four different high states corresponding to the contact between the trigger ball 517 and respective ones of the switches 509. In this respect, when the trigger ball 517 moves or rolls into contact with that portion of a primary lead 511 protruding into the interior of the recess 505, the weight of the trigger ball 517 (which may be fabricated from steel, copper, lead, or a heavy metal) facilitates the flexion or deflection of such primary lead 511 from its normal, unflexed position to its flexed position. The movement of such primary lead 511 to its flexed position results in the electrical contact of the free end thereof to a respective one of the secondary leads 513. Current is applied to the primary leads 511 via respective ones of the lead mounts 515. When a primary lead 511 contacts its corresponding secondary lead 513, a closed circuit is created, with the particular high state generated by the sensor 501 being dependent upon the secondary lead 513 with which electrical contact is established, i.e., each secondary lead 513 produces a different high state when contacted by its corresponding primary lead 511.

The sensor 501 of the fifth embodiment is preferably used in combination with programmable electronic circuitry which is similar to that previously discussed in relation to the first four embodiments of the present invention. The programmable electronic circuitry used in conjunction with the sensor 501 is in electrical communication therewith, and may be operative to compare at least two successive states generated by the sensor 501 to each other. The electronic circuitry may be programmed to translate at least some of the states generated by the sensor 501 into respective effects, and may further be programmed to produce a selected effect upon successive state of a prescribed sequence being transmitted thereto from the sensor 501. The effects may comprise visual outputs, audible outputs, or combinations thereof. The effects may also comprise electrical signals of differing frequencies and/or codings, infrared signals of differing codings, radio signals of differing frequencies and/or codings, microwave signals of differing frequencies and/or codings, or combinations thereof. The successive states generated by the sensor 501 which may be compared by the electronic circuitry correspond to the movement of the trigger ball 517 within the recess 505.

Those of ordinary skill in the art will recognize that the sensor 501 of the fifth embodiment may include one, two or three switches 509, or greater than four switches 509. If only a single switch 509 is disposed within the peripheral wall 507, the sensor 501 would be operative to generate only two different states, with a low state being generated when the trigger ball 517 is not in contact with the switch 509 and a high state being generated when the trigger ball 517 is in contact with the switch 509. If two switches 509 were disposed with the peripheral wall 507, the sensor would be operative to generate a low state when the trigger ball 517 is not in contact with either of the switches and two different high states corresponding to the contact between the trigger ball 517 and respective ones of the switches 509.

Figure 19:
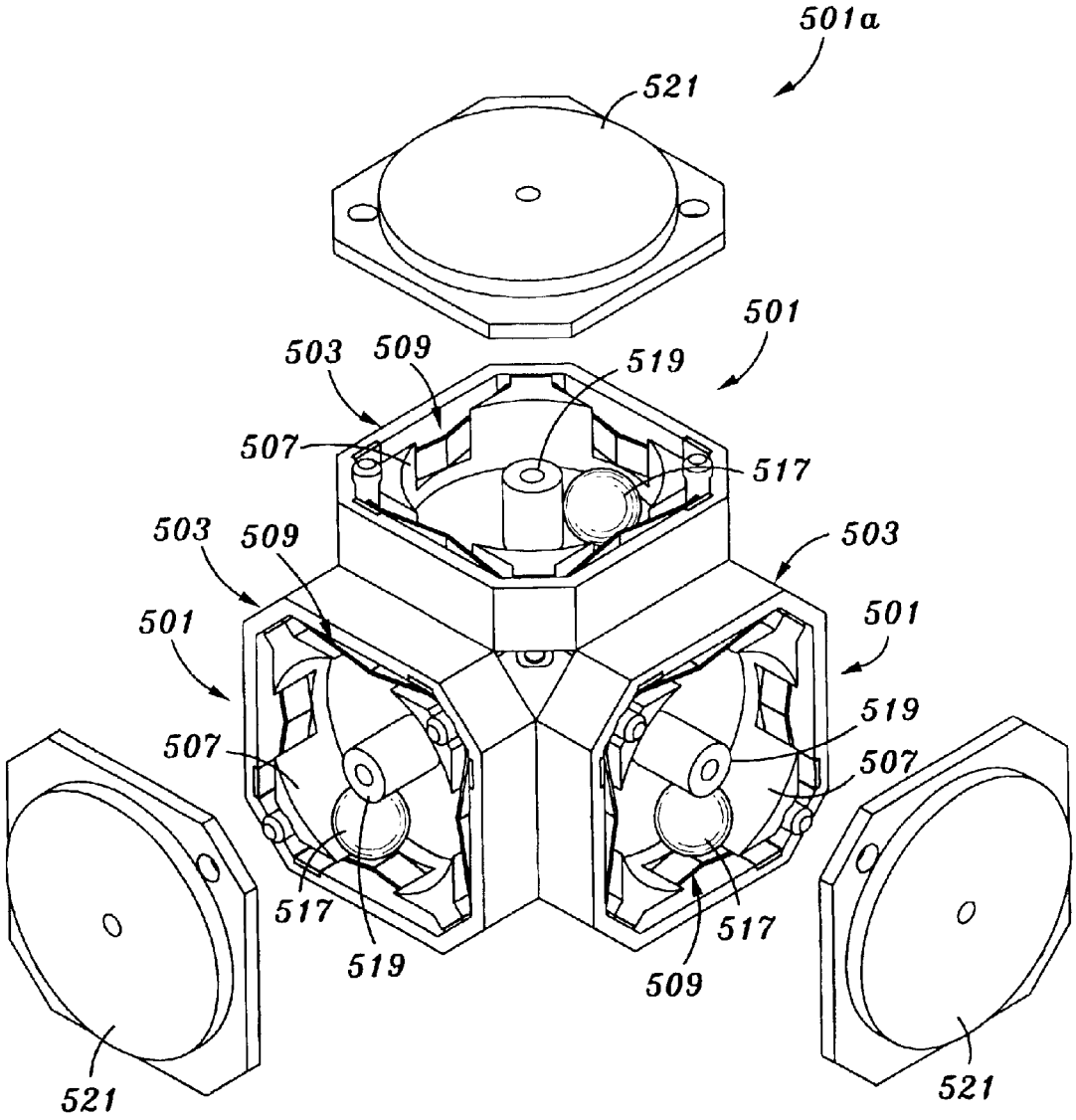
FIG. 19 is a perspective view of a multi-axis version of the sensor of the fifth embodiment, illustrating the cover plates as separated from the remainder thereof.

Referring now to FIG. 19, there is depicted a sensor 501*a* which is a three-axis version of the sensor 501. In the sensor 501*a*, the base members 503 of three identically configured sensors 501 are attached to each other or to a common mount such that the posts 519 are coaxially aligned with respective ones of three different axes which extend in generally perpendicular relation to each other. Each of the sensors 501 of the sensor 501*a* functions in the above-described manner. In the sensor 501*a*, assuming four switches 509 are disposed with the peripheral wall 507 of each of the base members 503, the sensor 501*a* would be operative to generate the low state when the trigger balls 517 of the sensors 501 are not in contact with any of the switches 509, and at least sixty-four different high states (four to the third power based on three axes) corresponding to the contact between the trigger balls 517 and respective ones of the switches 509. If only two switches 509 were included in each of the sensors 501, the sensor 501*a* would be operative to generate the low state when the trigger balls 517 are not in contact with any of the switches 509, and at least eight different high states (two to the third power based on three axes) corresponding to the contact between the trigger balls 517 and respective ones of the switches 509.

Though not shown, the sensor 501 of the fifth embodiment could also be provided in a two-axis version which would be similar to the three-axis version 501*a* with one of the sensors 501 being eliminated therefrom. In the two-axis, four switch per sensor combination, such sensor would be operative to generate the low state when the trigger balls 517 are not in contact with any of the switches 509, and at least sixteen different high states (four to the second power based on two axes) corresponding to the contact between the trigger balls 517 and respective ones of the switches 509. In the two-axis, two switch per sensor combination, such sensor would be operative to generate the low state when the trigger balls 517 are not in contact with any of the switches 509, and at least four different high states (two to the second power based on two axes) corresponding to the contact between the trigger balls 517 and respective ones of the switches 509.

Figure 21:
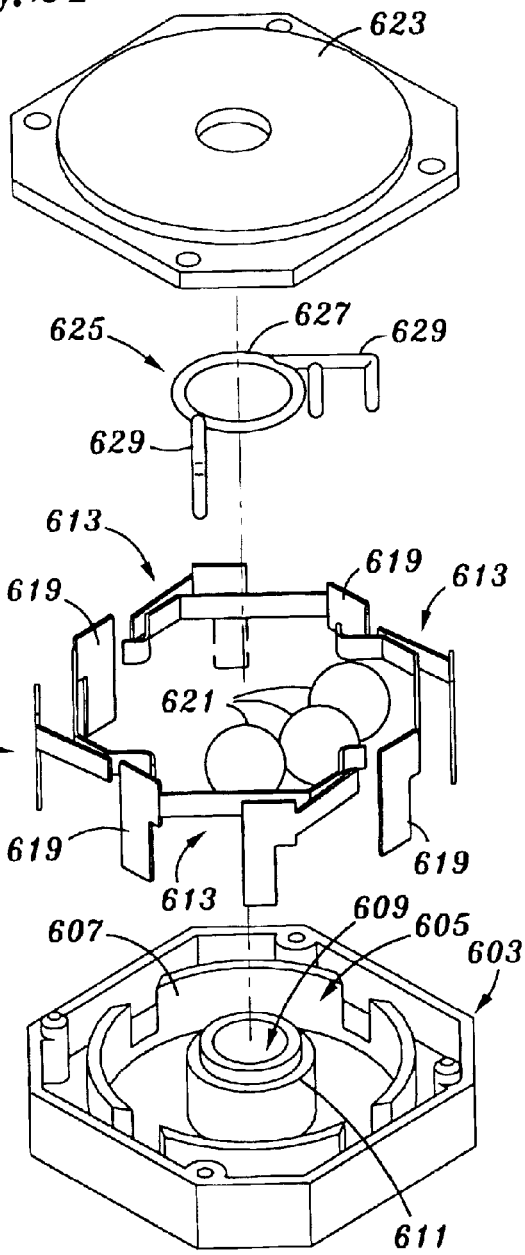
FIG. 21 is an exploded view of the sensor of the sixth embodiment.
Figure 20:
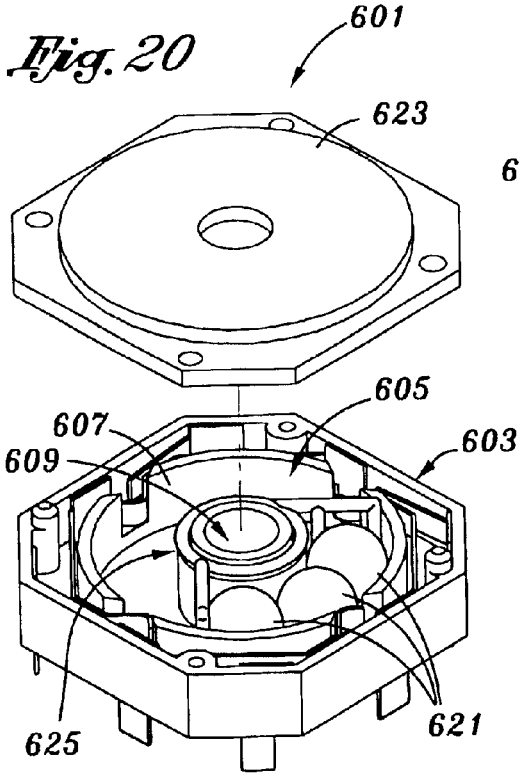
FIG. 20 is a top perspective view of a sensor constructed in accordance with a sixth embodiment of the present invention, illustrating the cover plate as separated from the remainder thereof.

Referring now to FIGS. 20–22, there is depicted a sensor 601 constructed in accordance with a sixth embodiment of the present invention. The sensor 601 is also intended for use in an interactive electronic device, and is similarly configured to the sensor 501 of the fifth embodiment. In this respect, the sensor 601 comprises a base member 603 having a recess 605 formed therein. The recess 605 is partially defined by a peripheral wall 607 of the base member 603. In the sensor 601, the peripheral wall 607 is preferably circularly configured, thus resulting in the recess 605 being circularly configured as well. Extending axially within the recess 605 is a cylindrically configured central post 609 of the base member 603. As is best seen in FIG. 21, the distal portion of the post 609 is of a reduced diameter, thus facilitating the formation of an annular shoulder 611 at the transition between the distal portion of the post 609 and the remainder thereof. The use of the shoulder 611 will be discussed in more detail below. Disposed within the peripheral wall 607 of the base member 603 are four switches 613 which are preferably spaced at intervals of approximately ninety degrees.

Figure 22A:
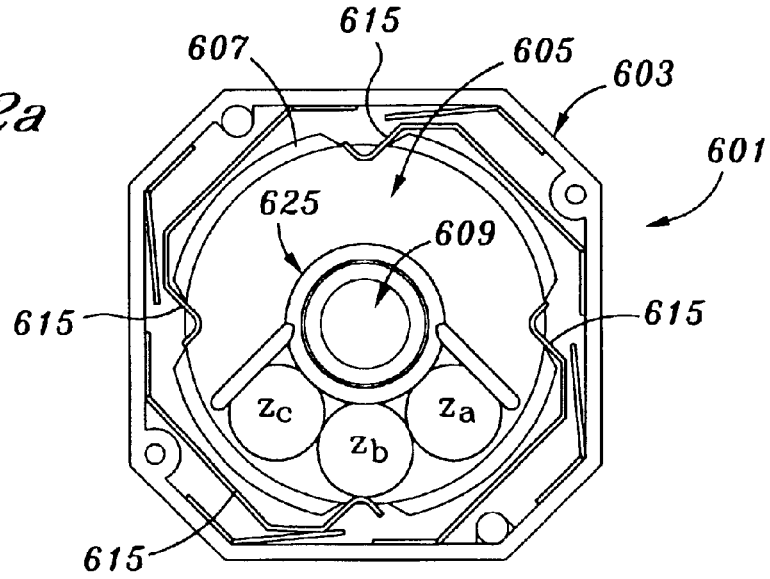
FIGS. 22*a*, 22*b*, 22*c* are top plan views of the sensor of the sixth embodiment not including the cover plate, illustrating the manner in which the switches of the sensor are individually or simultaneously actuated by the trigger mechanism of the sensor.
Figure 22B:
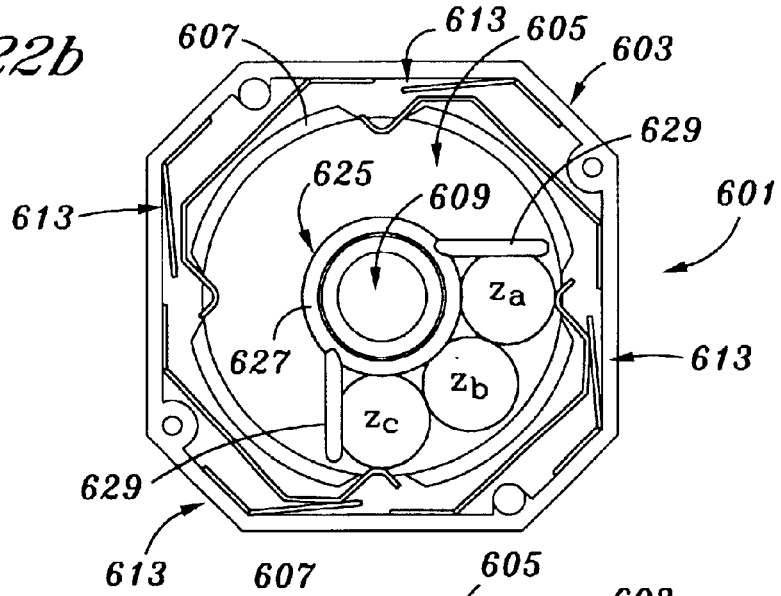
Figure 22C:
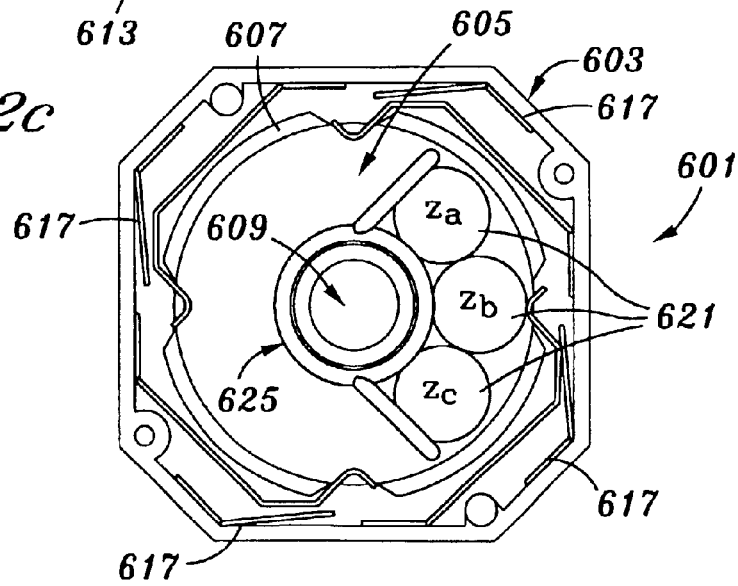

Each of the switches 613 preferably comprises a resilient primary lead 615 which is disposed within the peripheral wall 607 and is movable between flexed and unflexed positions. In addition to the primary lead 615, each of the switches 613 includes a secondary lead 617 which is disposed within the base member 603. As is best seen FIG. 21, one end of each primary lead 615 is integrally connected to a lead mount 619. The lead mounts 619 are insertable into the base member 603 along respective ones of the four sides defined thereby. The primary leads 615 are configured such that upon the insertion of the lead mounts 619 into the base member 603, those ends of the primary leads 615 opposite the ends connected to the lead mounts 619 protrude into the interior of the recess 605 via respective openings formed within the peripheral wall 607, as is best shown in FIGS. 22*a*, 22*b*, 22*c*. These openings are separated by intervals of approximately ninety degrees. The secondary leads 617 are inserted into the base member 603 at respective ones of the four corner regions defined thereby. Upon the insertion of the lead mounts 619 and secondary leads 617 into the base member 603 in the above-described manner, those ends of the primary leads 615 opposite the ends connected to the lead mounts 619 are disposed in spaced relation to respective ones of the secondary leads 617.

The sensor 601 of the sixth embodiment further comprises three spherically shaped trigger balls 621 which are disposed within the recess 605 and are freely movable about the peripheral wall 607. As they move within the recess 605, the trigger balls 621 are maintained along the peripheral wall 607 by the post 609 of the base member 603. Additionally, the trigger balls 621 are maintained within the recess 605 by a cover plate 623 which is attached to the base member 603 via fasteners such as screws. In the sensor 601, the trigger balls 621 are maintained in side-by-side relation to each other via a retainer member 625. The retainer member 625 includes an annular portion 627 which is rotatably connected to the post 609. Such rotatable connection is facilitated by advancing the annular portion 627 over the distal portion of the post 609 until such time as the annular portion 627 rests upon the shoulder 611. The annular portion 627 is maintained upon the post 609 by the attachment of the cover plate 623 to the base member 603. In addition to the annular portion 627, the retainer member 625 includes an identically configured pair of arm portions 629 which each have the general configuration of the letter F as best seen in FIG. 21. The retainer member 625 and trigger balls 621 are sized and configured relative to each other such that when the trigger balls 621 are captured between the arm portions 629 of the retainer member 625, the trigger balls 621 are maintained in side-by-side relation to each other, are each freely rotatable, and collectively cover about ninety degrees of the circular path defined between the peripheral wall 607 and post 609. In this respect, the axes of the trigger balls 621 are preferably spaced at intervals of approximately 45°.

The sensor 601 of the sixth embodiment is operative to generate at least four different states corresponding to respective positions of the sensor 601 relative to a reference plane, with the movement of the sensor 601 relative to the reference plane facilitating the movement of the trigger balls 621 as a group within the recess 605. More particularly, the sensor 601 is operative to generate a low state when the trigger balls 621 are not in contact with any of the switches 613, and in particular those portions of the primary leads 615 which protrude into the interior of the recess 605. Though not shown, it will be appreciated from FIGS. 22*a*, 22*b*, 22*c* that when the trigger balls 621 are not in contact with any of the switches 613, a portion of one of the primary leads 615 protruding into the recess 605 will extend between, but not be in contact with, an adjacent pair of the trigger balls 621. The sensor 601 is further operative to generate four different high states corresponding to contact between the center trigger ball 621 and a respective one of the switches 613 (examples of which are shown in FIGS. 22*a* and 22*c*), and four additional different high states corresponding to the outer pair of trigger balls 621 being in simultaneous contact with any pair of the switches 613 separated by a ninety degree interval (an example of which is shown in FIG. 22*b*).

When any trigger ball 621 moves or rolls into contact with that portion of a primary lead 615 protruding into the interior of the 605, the trigger ball 621 acts against such primary lead 615 in a manner facilitating the flexion or deflection thereof from its normal, unflexed position to its flexed position. As is seen in FIGS. 22*a*, 22*b*, 22*c*, the movement of any primary lead 615 to its flexed position results in the electrical contact of the free end thereof to a respective one of the secondary leads 617. Current is applied to the primary leads 615 via respective ones of the lead mounts 619. When the trigger balls 621 are positioned with the recess 605 such that a single primary lead 615 contacts its corresponding secondary lead 617, a closed circuit is created, with the particular high state generated by the sensor 601 being dependent upon the secondary lead 617 with which electrical contact is established, i.e., each secondary lead 617 produces a different high state when contacted by its corresponding primary lead 615. Alternatively, when the trigger balls 621 are positioned within the recess 605 such that a pair of primary leads 615 simultaneously contact their corresponding secondary leads 617, the particular high state generated by the sensor 601 is dependent upon the combination of secondary leads 617 with which electrical contact is established, i.e., a different high state is produced when any adjacent pair of secondary leads 617 are simultaneously contacted by their corresponding primary leads 615.

The sensor 601 of the sixth embodiment is preferably used in combination with programmable electronic circuitry which is similar to that previously discussed in relation to the sensor 501 of the fifth embodiment. The programmable electronic circuitry used in conjunction with the sensor 601 is in electrical communication therewith, and may be operative to compare at least two successive states generated by the sensor 601 to each other. The electronic circuitry may be programmed to translate at least some of the states generated by the sensor 601 into respective effects in the same manner previously discussed in relation to the sensor 501. The successive states generated by the sensor 601 which may be compared by the electronic circuitry correspond to the movement or rotation of the trigger balls 621 within the recess 605.

Referring now to FIG. 36, the electronic circuitry used in conjunction with the sensor 601 further includes the capability to discern sixteen different conditions of the sensor 601, and to compare successive conditions to each other to determine the path of movement (i.e., clockwise, counterclockwise) of the trigger balls 621 within the recess 605. In the chart shown in FIG. 36, the trigger balls 621 are identified as Za, Zb, and Zc. To establish a correlation between the sensor 601 and the chart shown in FIG. 36, the trigger balls 621 shown in FIGS. 22*a*, 22*b*, 22*c* are labeled as Za, Zb, and Zc, respectively.

FIG. 36 shows the various different states which will be generated by the sensor 601 depending upon a particular position of the center trigger ball 612 (labeled as Zb) within the recess 605. For example, if the trigger ball 621/Zb is located at the 90° position as shown in FIG. 22*c*, the trigger ball 621/Zb alone will facilitate the generation of a particular high state, since neither of the other two trigger balls 621/Za, Zc is in contact with a switch 613. If the trigger balls 621 then rotate slightly in a clockwise direction such that the center trigger ball 621/Zb moves from the 90° position to the 112.5° position, the sensor 601 will generate the low state since none of the trigger balls 621/Za, Zb, Zc are in contact with any of the switches 613. If the trigger balls 621 are then rotated slightly more in a clockwise direction such that the center trigger ball 621/Zb is positioned at the 135° position as is shown in FIG. 22*b*, a particular high state will be generated by the sensor 601 corresponding to the contact of the outer pair of trigger balls 621/Za, Zc against respective switches 613, and the absence of any contact between the center trigger ball 621/Zb and a switch 613.

Thus, reflected in FIG. 36 are the eight different high states which may be generated by the sensor 601 depending upon which individual switch 613 is being actuated by the trigger ball 621/Zb or which pair of switches 613 are simultaneously actuated by the outer pair of trigger balls 621/Za, Zc. FIG. 36 also reflects that the low state is generated eight different times as the trigger balls 621 complete a full clockwise or counter-clockwise rotation through the recess 605. Thus, during a complete clockwise or counter-clockwise rotation of the trigger balls 621, sixteen conditions are achieved comprising the sum of the eight different high states and the eight intervening low states. As indicated above, the electronic circuitry used in conjunction with the sensor 601 is able to discern these sixteen different conditions and compare any three of these conditions to each other for purposes of monitoring the location or direction of rotation of the trigger balls 621 within the recess 605. Indeed, the electronic circuitry may be programmed to produce a certain effect or combination of effects in response to any three successive conditions transmitted from the sensor 601.

Figure 23:
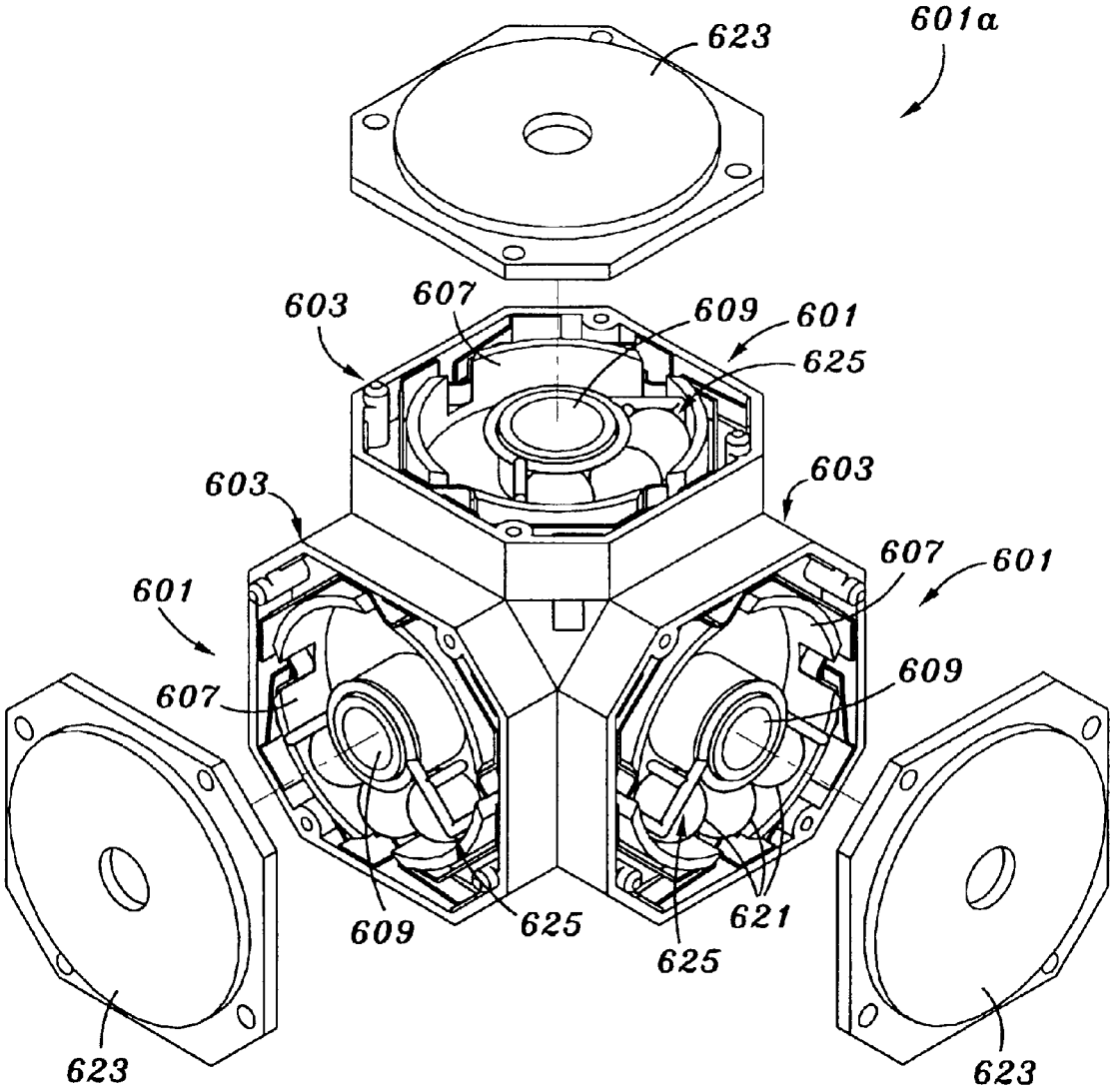
FIG. 23 is a perspective view of a multi-axis version of the sensor of the sixth embodiment, illustrating the cover plates as being separated from the remainder thereof.

Referring now to FIG. 23, there is depicted a sensor 601*a* which is a three-axis version of the sensor 601. In the sensor 601*a*, the base members 603 of three identically configured sensors 601 are attached to each other or to a common mount such that the posts 609 are coaxially aligned with respective ones of three different axes which extend in generally perpendicular relation to each other. Each of the sensors 601 of the sensor 601*a* functions in the above-described manner. In the sensor 601*a*, assuming four switches 613 are disposed within the peripheral wall 607 of each of the base members 603, the sensor 601*a* would be operative to generate the low state when the trigger balls 621 of the sensors 601 are not in contact with any of the switches 613, and at least five hundred twelve different high states (eight to the third power based on three axes) corresponding to the contact between the trigger balls 621 and at least one of the switches 613. The number of conditions generated by the sensor 601*a* would be sixteen to the third power. Importantly, the electronic circuitry used in conjunction with the sensor 601*a* could be provided with the capability of distinguishing such conditions from each other, and providing a prescribed response thereto. If only two switches 613 were included in each of the sensors 601 (the switches 613 being separated by 90°), the sensor 601*a* would be operative to generate the low state when the trigger balls 621 are not in contact with any of the switches 613, and at least twenty-seven different high states (three to the third power based on three axes) corresponding to the contact between the trigger balls 621 and at least one of the switches 613.

Though not shown, the sensor 601 of the sixth embodiment could also be provided in a two-axis version which would be similar to the three-axis version 601*a* with one of the sensors 601 being eliminated therefrom. In the two-axis, four switch per sensor combination, such sensor would be operative to generate the low state when the trigger balls 621 are not in contact with any of the switches 613, and at least sixty-four different high states (eight to the second power based on two axes) corresponding to the contact between the trigger balls 621 and at least one of the switches 613. In the two-axis, two switch combination (the switches 613 being separated by 90°), such sensor would be operative to generate the low state when the trigger balls 621 are not in contact with any of the switches 613, and at least nine different high states (three to the second power based on two axes) corresponding to the contact between the trigger balls 621 and at least one of the switches 613.

As indicated above, the sensor 601 could be provided with more than four switches 613. For example, the sensor 601 could be provided with eight switches 613 disposed in equally spaced relation to each other about the peripheral wall 607, with the size and spacing between the trigger balls 621 being reduced to allow for the actuation of such switches 613 individually or in pairs. A sensor including eight switches 613 would be capable of generating sixteen different high states, and thus thirty-two different conditions, as compared to the sixteen different conditions provided by the sensor 601 including four switches 613. A three-axis version of such sensor would be capable of producing or generating thirty-two to the third power different conditions, with the related electronic circuitry being provided with the capability to distinguish this number of conditions from each other and provide a prescribed response.

Referring now to FIGS. 37–40, it is contemplated that the sensor 601, the sensor 601*a*, or the two-axis version of the sensor 601 may be attached to various other items or devices, including a vehicle such as a bicycle (shown in FIG. 37), tricycle, skateboard, or scooter, to a belt (shown in FIG. 38), vest, shoulder pad, hat, helmet, or other article wearable by a user, a pair of gloves (shown in FIG. 39), or footwear such as athletic shoes (shown in FIG. 40) or roller blades. The use of the sensor 601, 601*a* with any of these items would impart the ability to generate various effects or outputs depending on the orientation of the item relative to the reference plane. For example, the banking or tilting of the bicycle including the sensor 601, 601*a* to different sides could facilitate the generation of corresponding effects or outputs. With regard to the use of the sensor 601, 601*a* with the gloves, it is contemplated that each of the gloves would be outfitted with the sensor 601, 601*a*, and would be in communication with another electronic device including a visual display such as an LCD or LED display. The large number of states/conditions each of the sensors 601, 601*a* is capable of producing could be processed and/or compared in a manner allowing for a virtual reality effect wherein the wearer of the gloves could observe corresponding motions or activities on the visual display of the electronic device. The wearer could also interact with another player wearing the same or similar device to conduct interactive play such as martial arts, Kung Fu fighting, or dancing over a computer network, a web network, or the internet. The possibilities are virtually unlimited due to the relatively compact size of the sensor 601, 601*a*.

It is further contemplated that two or three sensors 601 may be attached to any of the above-discussed devices/items or other items individually, with such attachment occurring at locations whereat the axes extending axially through respective ones of the posts 609 would themselves extend in generally perpendicular relation to each other. Thus, despite the sensors 601 being separate units, they may be fixed upon another item/device relative to each other so as to essentially mimic the three-axis version 601*a* or a two-axis version. Thus, there is no requirement that the base members 603 necessarily be attached to each other, or to a common base mount.

Figure 24:
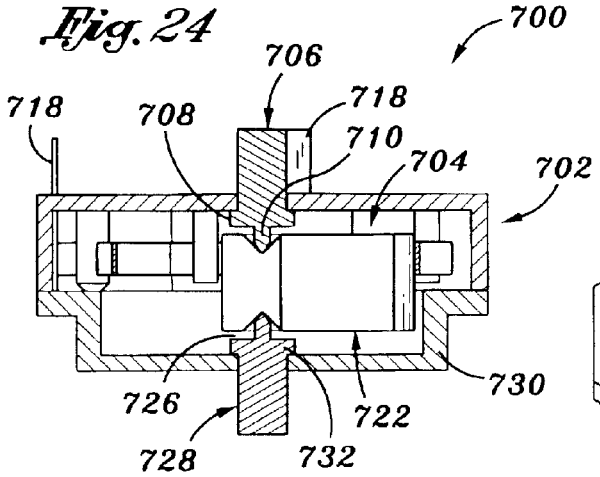
FIG. 24 is a cross-sectional view of a sensor constructed in accordance with a seventh embodiment of the present invention.
Figure 25:
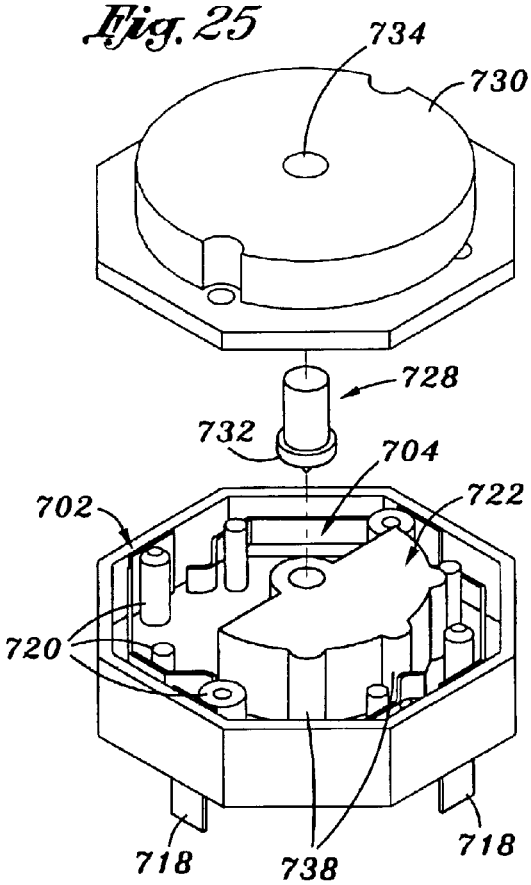
FIG. 25 is a partial exploded view of the sensor of the seventh embodiment.
Figure 26:
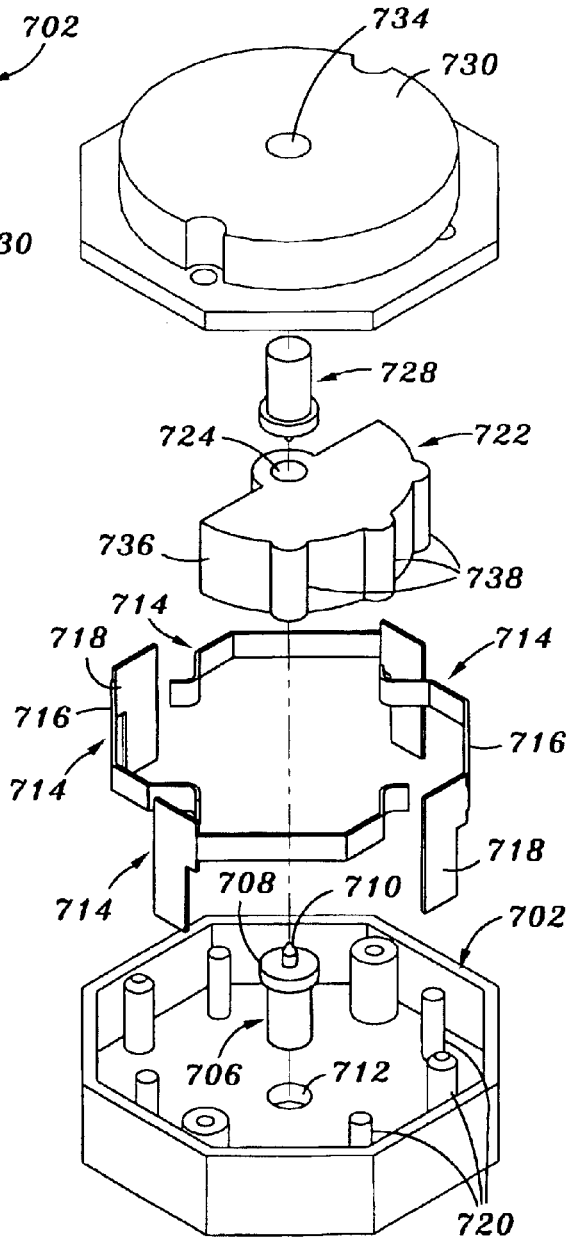
FIG. 26 is a fully exploded view of the sensor of the seventh embodiment.

Referring now to FIGS. 24–27, there is depicted a sensor 700 constructed in accordance with the seventh embodiment of the present invention. The sensor 700 is also intended for use in an interactive electronic device, and is similarly configured to the sensor 601 of the sixth embodiment. In this respect, the sensor 700 comprises a base member 702 having a recess 704 formed therein. The base member 702 has a generally octagonal configuration. As best seen in FIGS. 24 and 26, attached to the base member 702 is a generally cylindrical first support post 706, one end of which includes a flange portion 708 extending radially outward therefrom. Extending axially from that end of the first support post 706 including the flange portion 708 is a pin 710. The attachment of the first support post 706 to the base member 702 is facilitated by the advancement of the first support post 706 through a complimentary aperture 712 disposed within the base member 702, with such advancement being continued until such time as the flange portion 708 is abutted against the base member 702 such that the pin 710 resides within the recess 704.

Disposed within the recess 704 of the base member 702 are four switches 714. Each of the switches 714 preferably comprises a resilient, flexible lead portion 716. In addition to the lead portion 716, each the switches 714 includes a mount portion 718 which is integrally connected to one end of the lead portion 716. The mount portions 718 are insertable into respective openings within the base member 702 so as to protrude from a common side thereof as shown in FIGS. 24 and 25. The lead portions 716 are configured such that when the mount portions 718 are inserted into the base member 702, the distal ends of the lead portions 716 will be separated from each other by intervals of approximately ninety degrees, as best seen FIGS. 27*a*, 27*b*, 27*c*. The base member 702 is formed to include a plurality of bosses 720 which act against the lead and mount portions 716, 718 of each switch 714 in a manner maintaining the same at prescribed locations within the recess 704 of the base member 702. The distal end of each lead portion 716 is preferably configured to protrude radially inwardly into the recess 704 beyond the bosses 720.

The sensor 700 of the seventh embodiment further comprises a trigger plate 722 which is rotatably connected to the base member 702 and disposed within the recess 704 thereof. The trigger plate 722 has a generally semi-spherical shape, and is preferably fabricated from a conductive metal material. Disposed within opposed faces of the trigger plate 722 is a coaxially aligned pair of recesses 724 which are use to facilitate the rotatable connection of the trigger plate 722 to the base member 702. More particularly, when the trigger plate 722 is inserted into the recess 704, the pin 710 of the first support post 706 is received into one of the recesses 724. Inserted into remaining recess 724 is the pin 726 of a second support post 728 which is identical to the first support post 706 and attached to a cover plate 730 of the sensor 700 in a manner similar to the attachment of the first support post 706 to the base member 702. In this respect, the second support post 728 also includes a flange portion 732 which extends radially outward from that end thereof having the pin 726 extending axially therefrom. The attachment of the second support post 728 to the cover plate 730 is facilitated by the advancement of the second support post 728 through a complimentary aperture 734 disposed within the cover plate 730, with such advancement being continued until such time as the flange portion 732 is abutted against the cover plate 730 in the manner shown in FIG. 24. When the cover plate 730 is attached to the base member 702, the pin 726 of the second support post 728 is received into the remaining recess 724 of the trigger plate 722. Thus, upon the attachment of the cover plate 730 to the base member 702, the trigger plate 722 is captured within recess 704, and freely rotatable therewithin due to the receipt of the pins 710, 726 of the first and second support posts 706, 728 into respective ones of the recesses 724 within the trigger plate 722.

Though not shown, it will be recognized that the rotatable connection of the trigger plate 722 to the base member 702 may be facilitated by providing the trigger plate 722 with a pair of pins which protrude axially from opposed faces thereof at the same location as the recesses 724. The first and second support posts 706, 728 could alternatively be provided with recesses in place of the pins 710, 726, with the pins of the trigger plate 722 being received into respective ones of the recesses within the first and second support posts 706, 728 upon the assembly of the sensor 700. Though also not shown, the trigger plate 722 may alternatively be configured to include at least one arcuate slot on at least one face thereof having at least one metal ball disposed therein to assist in the rotation of the trigger plate 722 within the recess 704 of the base member 702.

As is further seen in FIG. 24, portions of the first and second support posts 706, 728 protrude from respective ones of the base member 702 and cover plate 730. Additionally, the distal ends of the pins 710, 726 loosely engage the trigger plate 722. The first and second support posts 706, 728 are also each preferably fabricated from a conductive metal material for reason which will be discussed in more detail below.

In the sensor 700 of the seventh embodiment, the trigger plate 722 defines an arcuate outer surface portion 736 which, due to the shape of the trigger plate 722, extends about one hundred eighty degrees. Formed on and extending radially outward from the outer surface portion 736 are three identically sized and configured protuberances 738 which are spaced from each other and the opposed ends of the outer surface portion 736 at intervals of approximately forty-five degrees. The protuberances 738 are used to facilitate the actuation of the switches in a manner which will be described below.

Figure 27A:
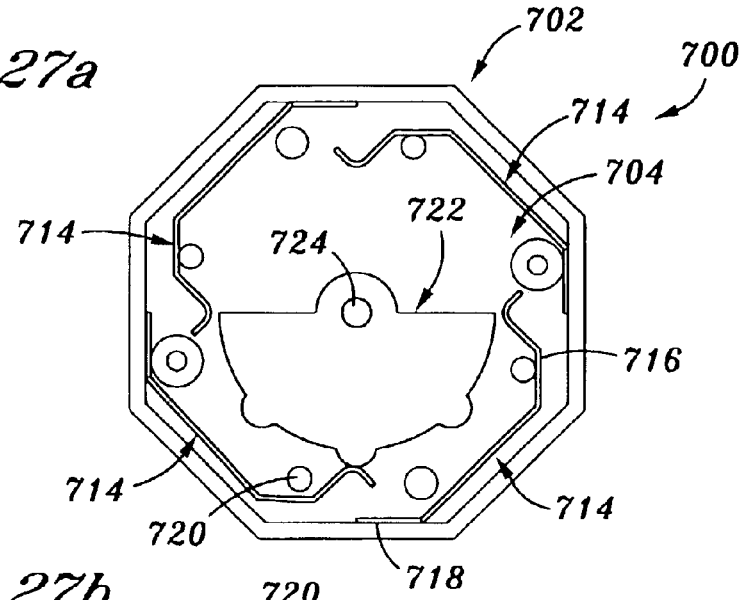
FIGS. 27*a*, 27*b*, 27*c* are top plan views of the sensor of the seventh embodiment not including the cover plate, illustrating the manner in which the switches of the sensor are individually or simultaneously actuated by the trigger mechanism of the sensor.
Figure 27B:
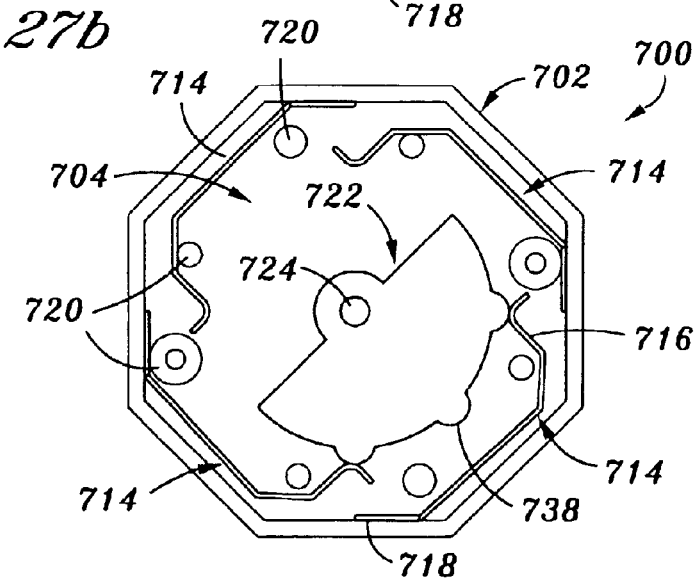
Figure 27C:
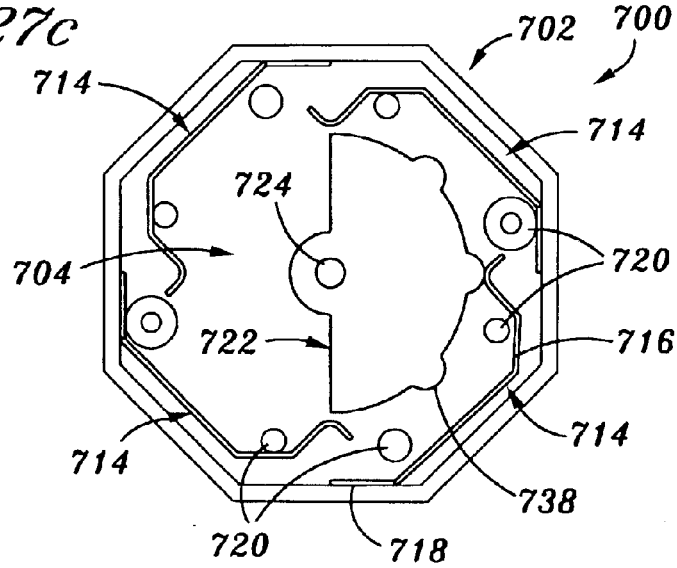

The sensor 700 of the seventh embodiment is operative to generate at least four different states corresponding to respective positions of the sensor 700 relative to a reference plane, with the movement of the sensor 700 relative to the reference plane facilitating the movement of the trigger plate 722 within the recess 704. More particularly, the sensor 700 is operative to generate a low state when the trigger plate 722, and in particular the protuberances 738 thereof, are not in contact with any of the switches 714, i.e., the distal ends of the lead portions 716 thereof which protrude into the interior of the recess 704 beyond the bosses 720. Though not shown, it will be appreciated from FIGS. 27*a*, 27*b*, 27*c* that when the protuberances 738 are not in contact with any of the switches 714, the distal end of one of the lead portions 716 will extend between an adjacent pair of protuberances 738, but will not be in contact with the outer surface portion 736 of the trigger plate 722. The sensor 700 is further operative to generate four different high states corresponding to contact between the center protuberance 738 and a respective one of the switches 714 (examples of which are shown in FIGS. 27*a* and 27*c*), and four additional different high states corresponding to the outer pair of protuberances 738 being in simultaneous contact with any pair of the distal ends of the lead portions 716 of the switches 714 separated by a ninety degree interval (an example of which is shown in FIG. 27*b*).

When any protuberance 738 of the trigger plate 722 moves into contact with the distal end of the lead portion 716 of a switch 714, the protuberance 738 acts against such lead portion 716 in a manner facilitating a slight amount of flexion thereof, which establishes firm contact between such lead portion 716 and the corresponding protuberance 738. Upon such contact, a closed circuit condition is created since there is a complete conductive path comprising one or both of the first and second support posts 706, 728, the trigger plate 722 (including the protuberances 738), and the switch 714 (including the lead and mount portions 716, 718). The particular high state generated by the sensor 700 is dependent upon the switch 714 with which electrical contact is established by the center protuberance 738, i.e., each switch 714 produces a different high state when contacted by the center protuberance 738. Alternatively, when the trigger plate 722 is positioned within the recess 704 such that the outer pair of protuberances 738 simultaneously contact a corresponding pair of switches 714, the particular high state generated by the sensor 700 is dependent upon the combination of switches 714 with which electrical contact is established, i.e., a different high state is produced when any adjacent pair of switches 714 are simultaneously contacted by the outer pair of protuberances 738.

The sensor 700 of the seventh embodiment is preferably used in combination with the programmable electronic circuitry previously described in relation to the sensor 601 of the sixth embodiment. The programmable electronic circuitry used in conjunction with the sensor 700 is in electrical communication therewith, and has the same functionality as the electronic circuitry described in relation to the sensor 601. The successive states generated by the sensor 700 which may be compared by the electronic circuitry correspond to the movement or rotation of the trigger plate 722 within the recess 704. One or both of the first and second support posts 706, 728, and each of the switches 714, are preferably in electrical communication with the electronic circuitry.

As will be recognized, the sensor 700 of the seventh embodiment has the capability of generating or producing sixteen different conditions in the same manner previously discussed in relation to the sensor 601. In this respect, the three protuberances 738 of the trigger plate 722 can be corresponded to the trigger balls 621 of the sensor 601. More particularly, with reference to the chart shown in FIG. 36, the center protuberance 738 would correspond to the trigger ball 621/Zb, with the outer pair of protuberances 738 corresponding to the trigger balls 621/Za, Zc, respectively. Thus, the electronic circuitry used in conjunction with the sensor 700 further includes the capability to discern these sixteen different conditions of the sensor 700, and to compare successive conditions to each other to determine the path of rotation (i.e., clockwise, counter-clockwise) of the trigger plate 722 within the recess 704. Additionally, the sensor 700 could also be outfitted with eight, rather than four switches 714 to impart the same functionality previously discussed in relation to providing the sensor 601 with eight switches 613.

Figure 28:
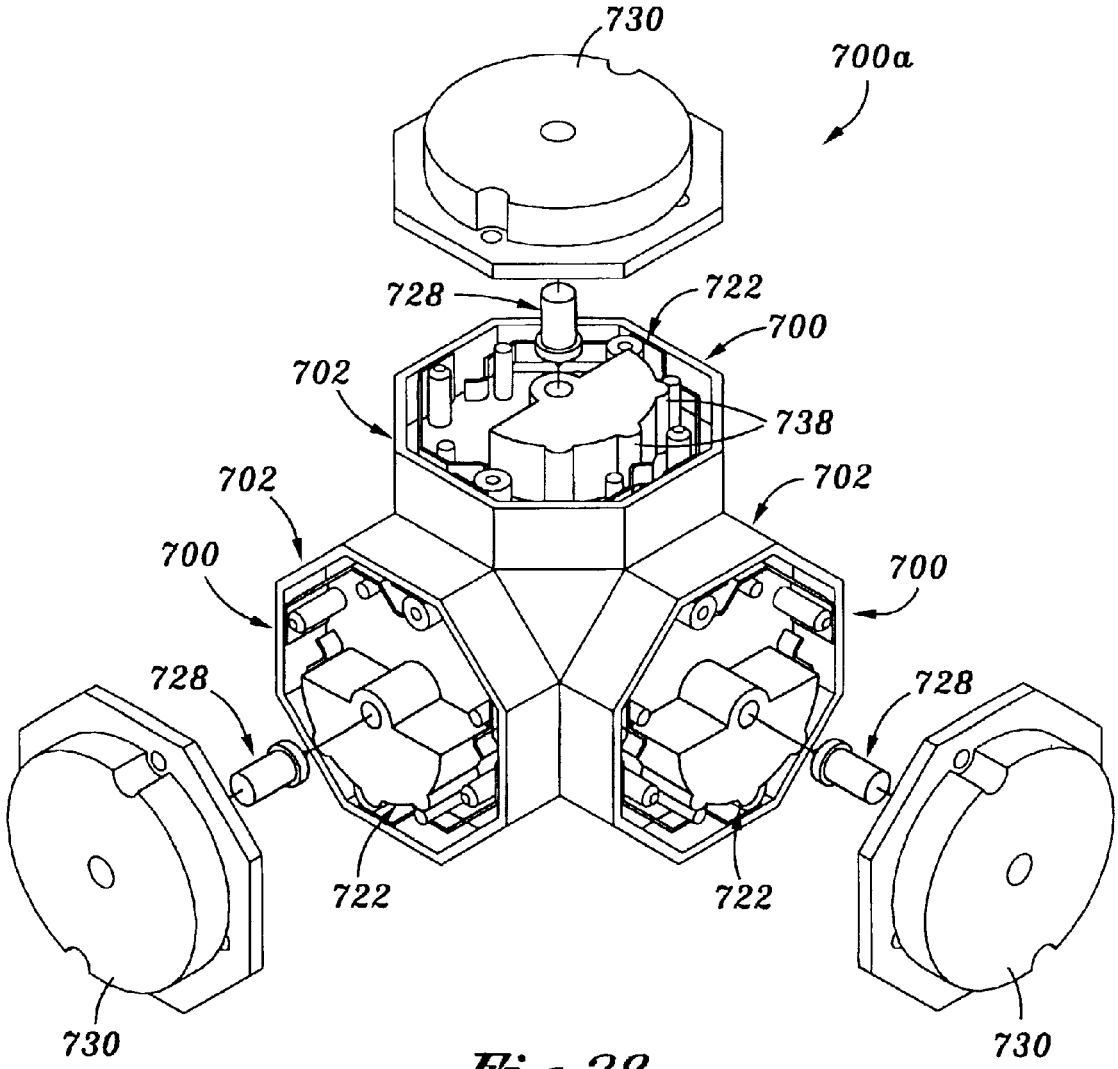
FIG. 28 is a perspective view of a multi-axis version of the sensor of the seventh embodiment, illustrating the cover plates as being separated from the remainder thereof.

Referring now to FIG. 28, there is depicted a sensor 700*a* which is a three-axis version of the sensor 700. In the sensor 700*a*, the base members 702 of three identically configured sensors 700 are attached to each other or to a common mount such that each corresponding pair of first and second support posts 706, 728 is coaxially aligned with respective ones of three different axes which extend in generally perpendicular relation to each other. Each of the sensors 700 of the sensor 700*a* functions in the above-described manner. In the sensor 700*a*, assuming four switches are disposed within the recess 704 of each of the base members 702, the sensor 700*a* would be operative to generate the low state when the protuberances 738 of the trigger plate 722 are not in contact with any of the switches 714, and at least five hundred twelve different high states (eight to the third power based on three axes) corresponding to the contact between the protuberances 738 and at least one of the switches 714. The number of conditions generated by the sensor 700*a* would be sixteen to the third power. Importantly, the electronic circuitry used in conjunction with the sensor 700*a* could be provided with the capability of distinguishing such conditions from each other, and providing a prescribed response thereto. If only two switches 714 were included in each of the sensors 700 (the switches 714 being separated by 90°), the sensor 700*a* would be operative to generate the low state when the protuberances 738 are not in contact with any of the switches 714, and at least twenty-seven different high states (three to the third power based on three axes) corresponding to the contact between the protuberances 738 and at least one of the switches 714.

Though also not shown, the sensor 700 of the seventh embodiment could also be provided in a two-axis version which would be similar to the three-axis version 700*a* with one of the sensors 700 being eliminated therefrom. In the two-axis, four switch per sensor combination, such sensor would be operative to generate the low state when the protuberances 738 are not in contact with any of the switches 714, and at least sixty-four different high states (eight to the second power based on two axes) corresponding to the contact between the protuberances 738 and at least one of the switches 714. In the two-axis, two switch combination (the switches 714 being separated by 90°), such sensor would be operative to generate the low state when the protuberances 738 are not in contact with any of the switches 714, and at least nine different high states (three to the second power based on two axes) corresponding to the contact between the protuberances 738 and at least one of the switches 714.

Moreover, it is contemplated that the sensor 700, 700*a* may be used in conjunction with the items shown in FIGS. 37–40 or other items as an alternative to the sensor 601, 601*a* due to the sensor 700, 700*a* possessing the same functionality. It is further contemplated that two or three sensors 700 may be attached to any of such devices/items individually, with such attachment occurring at locations whereat the axes extending axially through respective ones of the corresponding pairs of first and second support posts 706, 728 would themselves extend in generally perpendicular relation to each other. Thus, despite the sensors 700 being separate units, they may be fixed upon an item/device relative to each other so as to essentially mimic the three-axis version 700*a* or a two-axis version. Thus, as with the sensor 600, there is no requirement that the base members 702 necessarily be attached to each other or to a common base mount.

Figure 29:
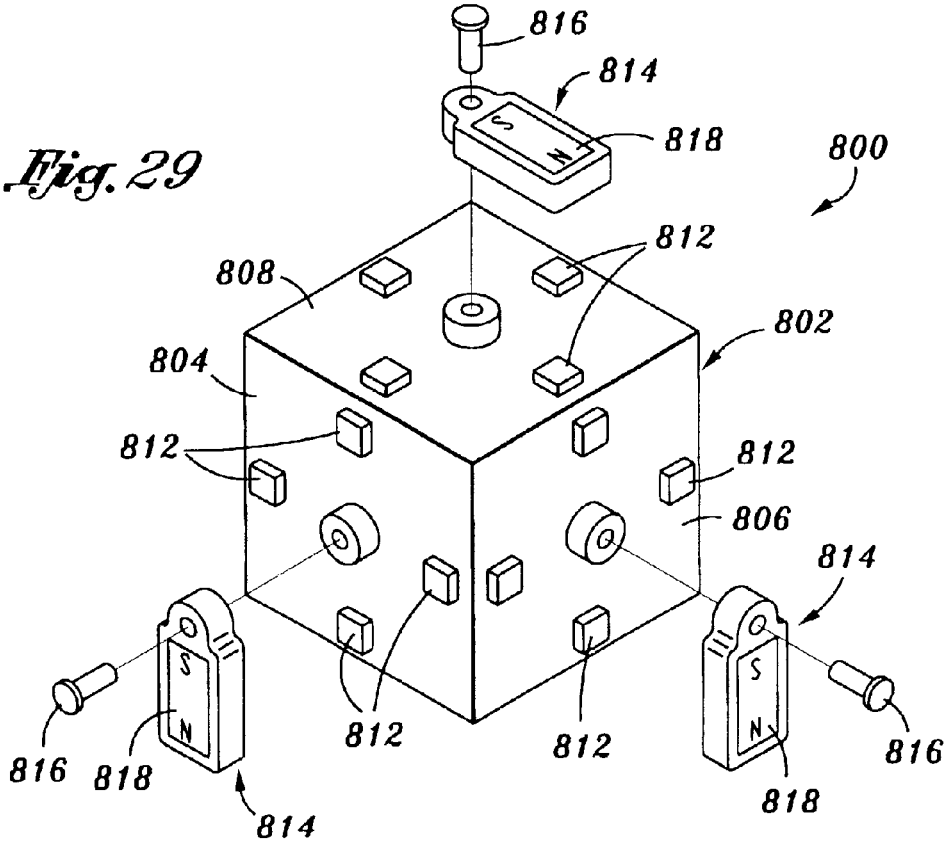
FIG. 29 is an exploded view of a sensor constructed in accordance with an eighth embodiment of the present invention.

Referring now to FIG. 29, there is depicted a sensor 800 constructed in accordance with an eighth embodiment of the present invention. The sensor 800 is also intended for use in an interactive electronic device. The sensor 800 comprises a base mount 802 which may be cubically shaped, and defines a first face 804, a second face 806, and a third face 808. The first, second and third faces 804, 806, 808 extend in generally perpendicular relation to each other. Formed in the center of each of the first, second and third faces 804, 806, 808 is a mounting post 810.

Disposed on each of the first, second and third faces 804, 806, 808 of the base mount 802 are four switches 812. Each set of four switches 812 is preferably arranged on a respective one of the first, second and third faces 804, 806, 808 so as to be equidistant from the corresponding mounting posts 810 and spaced at intervals of approximately 90°. The switches 812 each preferably comprise either a Hall effect switch or a Reed switch, though such switches 812 may alternately comprise any structure which may be actuated when subjected to a magnetic field. For example, rather than comprising a Hall effect switch or a Reed switch, the switch 812 could comprise a pair of metal spring contacts or contact plates (one being ferrous and the other being non-ferrous) drawn toward each other when exposed to the magnetic field of the corresponding magnet 818.

The sensor 800 of the eighth embodiment further comprises three identically configured sensor arms 814 which are rotatably connected to respective ones of the mounting posts 810 via fasteners such as pivot pins 816. Attached to each sensor arm 814 is a magnet 818 which produces a magnetic field. Each set of four switches 812 is oriented relative to a respective one of the sensor arms 814 such that each of the four switches 812 of the set may be exposed to the magnetic field of the magnet 818 upon the rotation of the corresponding sensor arm 814.

The sensor 800 of the eighth embodiment is operative to generate at least two different states corresponding to respective positions of the sensor 800 relative to a reference plane, with the movement of the sensor 800 relative to the reference plane facilitating the rotation of the sensor arms 814. More particularly, the sensor 800 is operative to generate a low state when none of the switches 812 are exposed to magnetic field of the magnet 818 of any one of the sensor arms 814, and at least sixty-four different high states corresponding (four to the third power based on three faces) to the exposure of respective ones of the switches 812 to the magnetic field of the magnet 818 of respective ones of the sensor arms 814.

Though not shown, it will recognized that each of the first, second and third faces 804, 806, 808 of the base mount 802 may be provided with fewer or greater than four switches 812, with the number of high states which may be generated by the sensor 800 corresponding to the number of switches 812 included on each face thereof. As indicated above, a high state is generated when any switch 812 on any one of the first, second and third faces 804, 806, 808 of the base mount 802 is exposed to the magnetic field of the magnet 818 of the corresponding sensor arm 814. It is contemplated that in the sensor 800 of the eighth embodiment, each of the switches 812 will produce a different high state when exposed to the magnetic field of the magnet 818 of the corresponding sensor arm 814. It is further contemplated that for each group of two or three switches 812 simultaneously exposed to the magnetic fields of the magnets 818 of corresponding sensor arms 814, a different high-state will be produced or generated by the sensor 800.

Though not shown, the sensor 800 may be provided in a single axis version or a two-axis version. In the single axis version, only the first face 804 would be defined by the base mount 802, thus providing the sensor with the capability of generating only four different high states corresponding to the exposure of respective ones of the switches 812 to the magnetic field of the magnet 818 of the sensor arm 814, and the low state when none of the switches 812 are exposed to the magnetic field of the magnet 818. In the two-axis version, the base mount 802 would be formed to define only the first and second faces 804, 806 which extend in generally perpendicular relation to each other. The two-axis version would be operative to generate the low state when none of the switches 812 are exposed to the magnetic field of the magnet 818 of any one of the sensor arms 814, and at least sixteen different high states (four to the second power based on two faces) corresponding to the exposure of respective ones of the switches 812 to the magnetic field of the magnet 818 of respective ones of the sensor arms 814.

The sensor 800 of the eighth embodiment is preferably used in combination with the same programable electronic circuitry previously discussed in relation to the fifth, sixth and seventh embodiments. The programable electronic circuitry used in conjunction with the sensor 800 is in electrical communication therewith, and may be operative to compare at least two successive states or conditions generated by the sensor 800 to each other. The successive states or conditions generated by the sensor 800 which may be compared by the electronic circuitry correspond to the movement or rotation of the sensor arms 814 relative to respective ones of the first, second and third faces 804, 806, 808 of the base mount 802.

Figure 30:
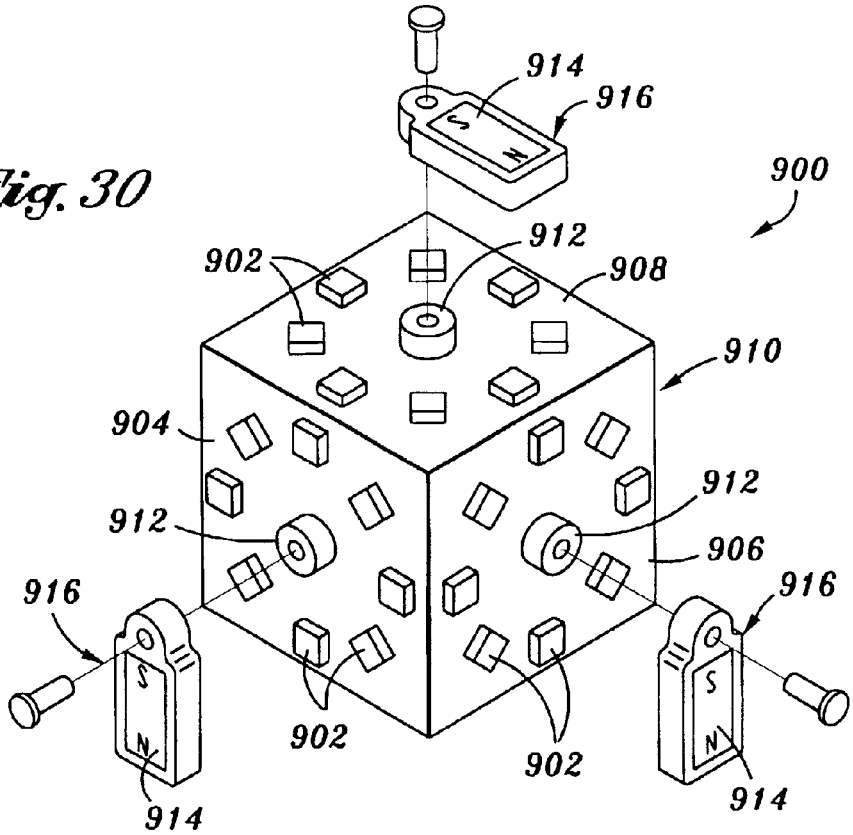
FIG. 30 is an exploded view of a sensor constructed in accordance with a ninth embodiment of the present invention.

Referring now to FIG. 30, there is depicted a sensor 900 constructed in accordance with a ninth embodiment of the present invention. The sensor 900 of the ninth embodiment is identical to the sensor 800 of the eighth embodiment, with the sole distinction being that in the sensor 900 of the ninth embodiment, eight switches 902 are included on each of the first, second and third faces 904, 906, 908 of the base mount 910. Each set of eight switches 902 is preferably arranged on a respective one of the first, second and third faces 904, 906, 908 so as to be equidistant from the corresponding mounting post 912 and spaced at intervals of approximately 45° degrees.

The sensor 900 of the ninth embodiment is operative to generate a low state when none of the switches 902 are exposed to the magnetic field of the magnet 914 of any one of the sensor arms 916, and at least five hundred twelve different high states (eight to the third power based on three faces) corresponding to the exposure of respective ones of the switches 902 to the magnetic field of the magnet 914 of respective ones of the sensor arms 916.

In the sensor 900 of the ninth embodiment, each of the switches 902 will produce a different high state when exposed to the magnetic field of the magnet 914 of the corresponding sensor arm 916. It is contemplated that for each group of two or three switches 902 simultaneously exposed to the magnetic fields of the magnets 914 of corresponding sensor arms 916, a different high state will be produced or generated by the sensor 900. Though not shown, the sensor 900 may be provided in a single axis version or a two-axis version. In the single axis version, only the first face 904 would be defined by the base mount 910, thus providing the sensor with the capability of generating only eight different high states corresponding to the exposure of respective ones of the switches 902 to the magnetic field of the magnet 914 of the sensor arm 916, and the low state when none of the switches 902 are exposed to magnetic field of the magnet 914. In the two-axis version, the base mount 910 would be formed to define only the first and second faces 904, 906 which extend in generally perpendicular relation to each other. The two-axis version would be operative to generate the low state when none of the switches 902 are exposed to the magnetic field of the magnet 914 of any one of the sensor arms 916, and at least sixty-four different high states (eight to the second power based on two faces) corresponding the exposure of respective ones of the switches 902 to the magnetic field of the magnet 914 of respective ones of the sensor arms 916.

The sensor 900 of the ninth embodiment is also preferably used in combination with the same programable electronic circuitry previously discussed in relation to the fifth through eighth embodiments. The programable electronic circuitry used in conjunction with the sensor 900 is in electrical communication therewith, and may be operative to compare at least two successive states or conditions generated by the sensor 900 to each other. The successive states or conditions generated by the sensor 900 which may be compared by the electronic circuitry correspond to the movement or rotation of the sensor arms 916 relative, to respective ones of the first, second and third faces 904, 906, 908 of the base mount 910.

Figure 31:
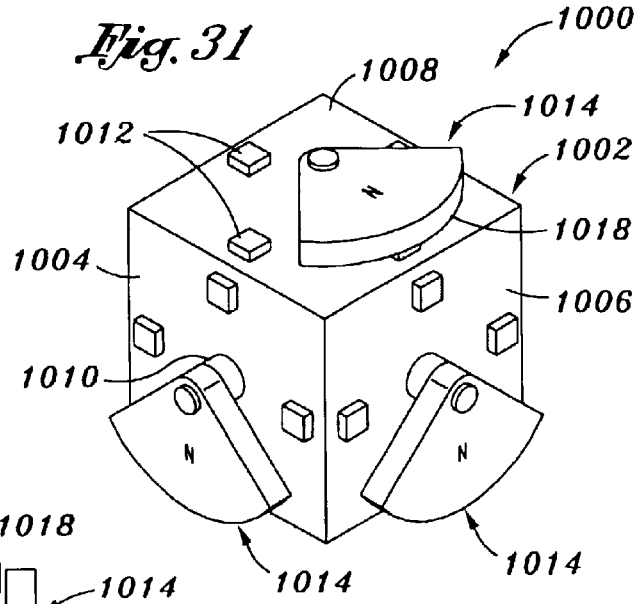
FIG. 31 is a top perspective view of a sensor constructed in accordance with a tenth embodiment of the present invention.
Figure 32:
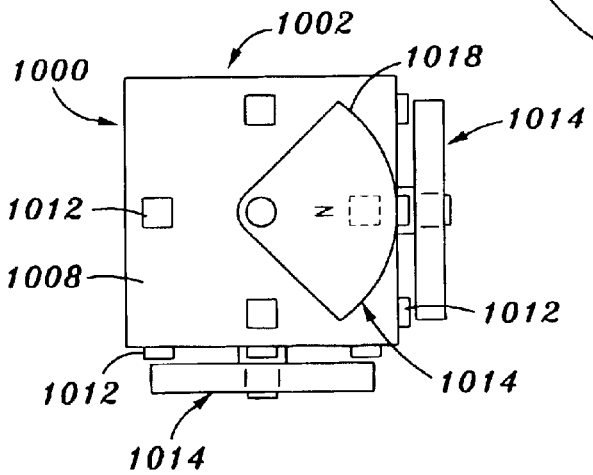
FIG. 32 is a top plan view of the sensor of the tenth embodiment.
Figure 33:
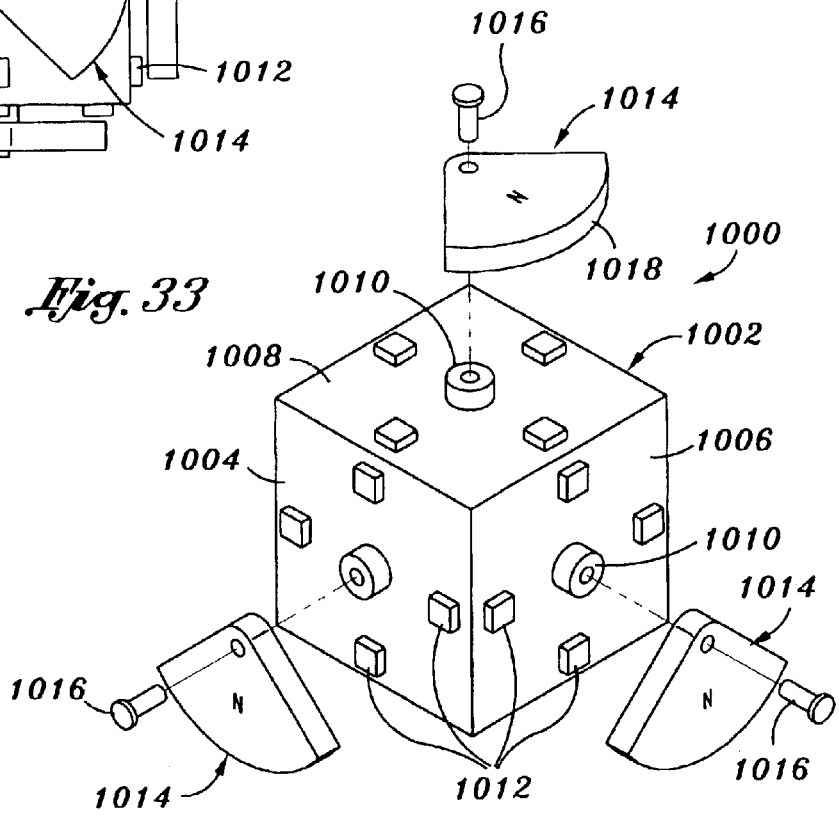
FIG. 33 is an exploded view of the sensor of the tenth embodiment.
Figure 37:
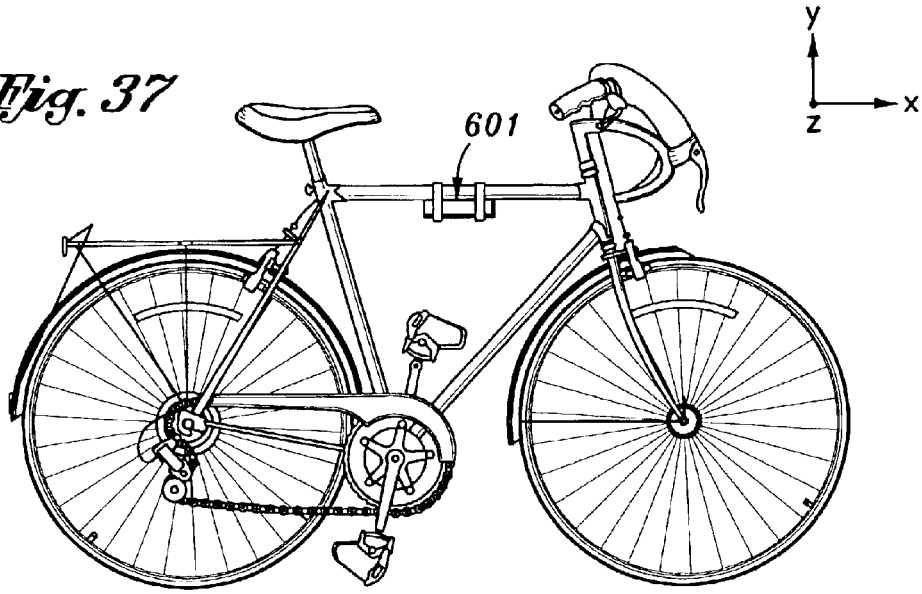
FIG. 37 is a perspective view illustrating the use of the sensor of the sixth or seventh embodiments in combination with a vehicle.
Figure 38:
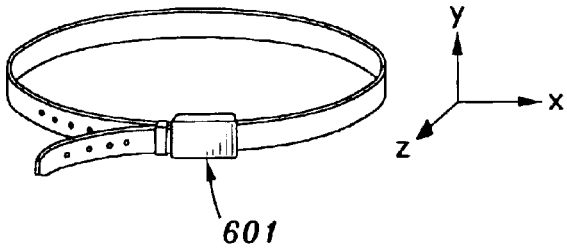
FIG. 38 is a perspective view illustrating use of the sensor of the sixth or seventh embodiments in combination with a device wearable by a user.
Figure 39:
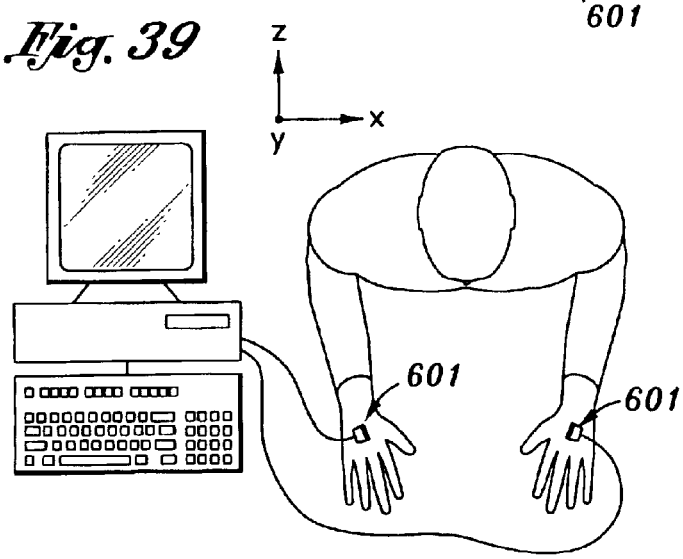
FIG. 39 is a perspective view illustrating the use of the sensor of the sixth or seventh embodiments in combination with a pair of gloves.
Figure 40:
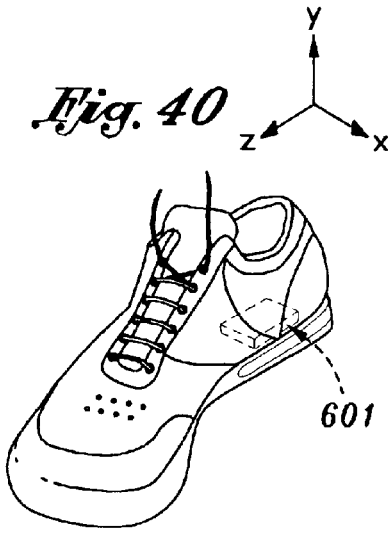
FIG. 40 is a perspective view illustrating the use of the sensor of the sixth or seventh embodiments in combination with footwear.

Referring now to FIGS. 31–33 there is depicted a sensor 1000 constructed in accordance with a tenth embodiment of the present invention. The sensor 1000 is similar to the sensor 800 of the eighth embodiment, and is also intended for use in an interactive electronic device. The sensor 1000 comprises a base mount 1002 which may be cubically shaped, and defines a first face 1004, a second face 1006, and a third face 1008. The first, second and third faces 1004, 1006, 1008 extend in generally perpendicular relation to each other. Formed in the center of each of the first, second and third faces 1004, 1006, 1008 is a mounting post 1010.

Disposed on each of the first, second and third faces 1004, 1006, 1008 of the base mount 1002 are four switches 1012. Each set of four switches 1012 is preferably arranged on a respective one of the first, second and third faces 1004, 1006, 1008 so as to be equidistant from the corresponding mounting post 1010 and spaced at intervals of approximately 90°. The switches 1012 each preferably comprise a Hall effect switch or a Reed switch, though such switches 1012 may alternatively comprise any structure which may be actuated when subjected to a magnetic field.

The sensor 1000 of the tenth embodiment further comprises three identically configured trigger magnets 1014 which are rotatably connected to respective ones of the mounting posts 1010 via fasteners such pivot pins 1016. Each trigger magnet 114 preferably has a generally wedge-shaped configuration, and defines an arcuate outer surface portion 1018 spanning about 90°. Each set of four switches 1012 is oriented relative to a respective one of the trigger magnets 1014 such that each of the four switches 1012 of each set may be exposed either individually or in pairs to the magnetic field of the corresponding trigger magnet 1014 upon the rotation thereof. In this respect, as is most apparent from FIG. 32, the size and configuration of each trigger magnet 1014 allows the same to extend over either a single switch 1012 or a pair of switches 1012 which are separated by a 90° interval.

The sensor 1000 of the tenth embodiment is operative to generate at least three different states corresponding to respective positions of the sensor 1000 relative to a reference plane, with the movement of the sensor 1000 relative to the reference plane facilitating the rotation of the trigger magnets 1014. More particularly, the sensor 1000 is operative to generate at least five hundred twelve different high states (eight to the third power based on three faces) corresponding to the exposure of at least three of the switches 1012 to the magnetic fields of respective ones of the trigger magnets 1014.

In the sensor 1000, a high state is generated when any switch 1012 on any of the first, second and third faces 1004, 1006, 1008 of the base mount 1002 is exposed to the magnetic field of the corresponding trigger magnet 1014. In the sensor 1000, the particular high state generated thereby is dependent upon the switch 1012 which is exposed to the magnetic field of the corresponding trigger magnet 1014, i.e., each switch 1012 produces a different high state when individually exposed to the magnetic field of the corresponding trigger magnet 1014. Alternatively, when any trigger magnet 1014 is positioned such that an adjacent pair of switches 1012 are simultaneously exposed to the magnetic field thereof, the particular high state generated by the sensor 1000 is dependent upon the combination of the switches 1012 exposed to the magnetic field of the corresponding trigger magnet 1014, i.e., a different high state is produced when any adjacent pair of switches 1012 are simultaneously exposed to the magnetic field of the corresponding trigger magnet 1014.

Though not shown, the sensor 1000 may be provided in a single axis version or a two-axis version. In the single axis version, only the first face 1004 would be defined by the base mount 1002, thus providing the sensor with the capability of generating only eight different high states corresponding to the exposure of respective ones of the switches 1012 to the magnetic field of the trigger magnet 1014, and the simultaneous exposure of any pair of switches 1012 separated by a 90° interval to the magnetic field of the trigger magnet 1014. In the two-axis version, the base mount 1002 would be formed to define only the first and second faces 1004, 1006 which extend in generally perpendicular relation to each other. The two-axis version would be operative to generate at least sixty-four different high states (eight to the second power based on two faces) corresponding to the exposure of at least two of the switches 1012 to the magnetic field of respective ones of the trigger magnets 1014. Moreover, it will be recognized that fewer or greater than four switches 1012 may be included on each of the first, second and third faces 1004, 1006, 1008. For example, if only two switches 1012 separated by a 90° interval were included on each of the first, second and third faces 1004, 1006, 1008, the sensor 100 would be capable of generating twenty-seven different high states (three to the third power based in three faces) corresponding to the exposure of at least one of the switches 1012 to the magnetic field of at least one of the trigger magnets 1014.

The sensor 1000 of the tenth embodiment is preferably used in combination with the same programable electronic circuitry previously discussed in relation to the fifth through ninth embodiments. The programable electronic circuitry used in conjunction with the sensor 1000 is in electrical communication therewith, and may be operative to compare at least two successive states or conditions generated by the sensor 1000 to each other. The successive states or conditions generated by the sensor 1000 which may be compared by the electronic circuitry correspond to the movement or rotation of the trigger magnets 1014 relative to respective ones of the first, second and third faces 1004, 1006, 1008 of the base mount 1002.

Those of ordinary skill in the art will recognize that a multi-axis version of a sensor of the present invention may be assembled by combining two or more sensors constructed in accordance with any embodiment of the present invention with each other. For example, FIG. 34 perspectively illustrates a two-axis sensor 2000 constructed in accordance with an eleventh embodiment of the present invention which comprises a combination of the sensor 500 of the third embodiment originally shown in FIGS. 14*a* and 14*b*, and the sensor 501 of the fifth embodiment shown in FIGS. 16–18. Similarly, FIG. 35 perspectively illustrates a two-axis sensor 3000 constructed in accordance with a twelfth embodiment of the present invention which comprises a combination of the sensor 500 of the third embodiment and a single axis version of the sensor 800 of the eighth embodiment. Those of ordinary skill in art will recognize that the sensors 2000, 3000 shown in FIGS. 34 and 35 are exemplary only, and do not represent the full range of combinations available using the sensors of the various embodiments of the present invention as described above.

Additional modifications and improvements of the present invention may also be apparent to those of ordinary skill in the art. For example, as indicated above, the actuators and switches of the various sensors need not necessarily be attached to a common base mount. In this respect, the various actuators and switches may be attached to two or more separate base mounts or similar support structures which are arranged relative to each other as needed to achieve the necessary orientations of the actuators relative to respective ones of the switches. Additionally, sensors constructed in accordance with embodiments of the present invention in addition to the sixth and seventh embodiments may be used in conjunction with those devices/articles shown in FIGS. 37–40. Further, the trigger plate 722 described in relation to the seventh embodiment may be formed such that the outer surface portion 736 thereof extends more or less than 180°. For example, the trigger plate 722 may be formed such that the outer surface portion 736 spans 270°, with the resultant increase in the size of the trigger plate 722 increasing the mass or weight thereof. However, in such alternately configured trigger plate 722, the protuberances 738 would still preferably be spaced from each other at intervals of approximately 45°.

Moreover, in any of the above-described embodiments of the sensor, the cover plate need not be releasably attached to the corresponding base member via fasteners such as screws. Rather, the cover plate could be permanently affixed to the corresponding base member via ultrasonic bonding or through the use of an adhesive. Additionally, in any multi-axis embodiment of the sensor of the present invention, the axes does not necessarily have to extend in perpendicular relation to each other. A non-perpendicular relationship between the axes could occur when the base members of the sensors are attached to each other or to a common base mount, or are individually attached to any one of the above-discussed devices/items.

In addition to the foregoing, it is contemplated that in the sensor 601 of the sixth embodiment, the number of switches 613 could be increased from four to eight, with such switches 613 being separated by intervals of approximately 22.5°. The inclusion of eight switches 613 would require that the trigger balls 621 be reduced in size so as to collectively span approximately 45°, with the axes of the trigger balls 621 being spaced at intervals of approximately 22.5°. The sensor 601 including eight switches would be capable of generating sixteen different high states. In a similar manner, the number of switches 714 included in the sensor 700 of the seventh embodiment could be increased from four to eight, with the spacing between the protuberances 738 being reduced from intervals of approximately 45° to intervals of approximately 22.5°. If assembled to include eight switches 714, the sensor 700 of the seventh embodiment would also be capable of generating sixteen different high states.

The programmable electronic circuitry used in conjunction with the sensor of any embodiment of the present invention may also be programmed to record or memorize the position of any trigger mechanism of any sensor at any point in time. This recorded time data could be compared by the electronic circuitry for purposes of facilitating the selective generation of one or more effects.

The programmable electronic circuitry used in conjunction with any embodiment of the present invention is operative to translate the high states generated by the sensor into respective effects which can be produced by the interactive electronic device either individually or in any combination. For example, the electronic circuitry could cause the particular high state generated by the contact of the trigger mechanism to a single switch to be translated into a respective effect which is produced individually by the electronic device, could cause the high state generated by the contact between the trigger mechanism and any pair of switches to be translated into a respective effect which is produced individually by the electronic device, or could cause two different high states generated by the contact between the trigger mechanism and two different switches to be translated into two different respective effects which are produced by the electronic device at the same time. Thus, a three axis version of the sensor and its accompanying electronic circuitry could, for example, facilitate the simultaneous production of six different sound effects from an electronic device. Two of these sound effects would be produced as a result of the contact between the trigger mechanism and two of the switches within the base member positioned along the first axis, with another two sound effects being produced as a result of the contact between the trigger mechanism and two of the switches within the base member positioned along the second axis, and the final two sound effects being produced as a result of the contact between the trigger mechanism and two of the switches within the base member positioned along the third axis. Due to the capability of the electronic circuitry to record or memorize positions of the trigger mechanism at any point in time as discussed above, the electronic circuitry may be programmed to cause two or more effects to be simultaneously produced by the electronic device in any combination.

Moreover, the sensors of the present invention may be used in relation to a wide variety of applications other than for those discussed above. For example, two or more separate sensors may be employed in a toy such as a teddy bear, with sensors being included in the hand, chest, and/or head of the teddy bear. The electronic circuitry used in conjunction with such sensors could be programmed to determine the relative positions of the various sensors relative to each other for purposes of recognizing different postures of the teddy bear, and to generate different effects/outputs corresponding to each particular posture. Thus, the particular combinations of parts described and illustrated herein is intended to represent only certain embodiments of the present invention, and is not intended to serve as limitations of alternative devices within the spirit and scope of the invention.

What is claimed is:

1. A sensor for use in an interactive electronic device, the sensor comprising:

a base member defining first and second axes which extend in generally perpendicular relation to each other and having at least two circularly configured recesses formed therein, each of the recesses being partially defined by a respective peripheral wall of the base member, with each of the first and second axes extending axially through a respective one of the recesses;

at least two switches disposed within the peripheral wall of each of the recesses in spaced relation to each other; and at least one trigger ball disposed within each of the recesses and freely moveable about the peripheral wall thereof;

the sensor being operative to generate different states corresponding to respective positions of the sensor relative to a reference plane, with a low state being generated when the trigger balls are not in contact with any of the switches and at least four different high states being generated corresponding to contact between the trigger balls and respective ones of the switches.

2. The sensor of claim 1 wherein:

the base member comprises two separate base member sections which define respective ones of the first and second axes; and the recesses are formed within respective ones of the base member sections, with the first and second axes extending axially through respective ones of the recesses;

the base member sections being attachable to a device such that the first and second axes extend in generally perpendicular relation to each other.

3. The sensor of claim 1 further in combination with programmable electronic circuitry which is in electrical communication with the sensor and is operative to translate at least some of the states generated by the sensor into respective effects.

4. The sensor of claim 3 wherein the electronic circuitry is programmed to compare at least two successive states generated by the sensor to each other.

5. The sensor of claim 4 wherein the electronic circuitry is further programmed to produce a selected effect upon successive states of a prescribed sequence being transmitted thereto from the sensor.

6. A sensor for use in an interactive electronic device, the sensor comprising:

a base member defining first, second and third axes which extend in generally perpendicular relation to each other and having at least three circularly configured recesses formed therein, each of the recesses being partially defined by a respective peripheral wall of the base member, with each of the first, second and third axes extending axially through a respective one of the recesses;

at least two switches disposed within the peripheral wall of each of the recesses in spaced relation to each other; and at least one trigger ball disposed within each of the recesses and freely moveable about the peripheral wall thereof;

the sensor being operative to generate different states corresponding to respective positions of the sensor relative to a reference plane, with a low state being generated when the trigger balls are not in contact with any of the switches and at least eight different high states being generated corresponding to contact between the trigger balls and respective ones of the switches.

7. The sensor of claim 6 wherein:

the base member comprises three separate base member sections which define respective ones of the first, second and third axes; and the recesses are formed within respective ones of the base member sections, with the first, second and third axes extending axially through respective ones of the recesses;

the base member sections being attachable to a device such that the first, second and third axes extend in generally perpendicular relation to each other.

8. The sensor of claim 6 further in combination with programmable electronic circuitry which is in electrical communication with the sensor and is operative to translate at least some of the states generated by the sensor into respective effects.

9. The sensor of claim 8 wherein the electronic circuitry is programmed to compare at least two successive states generated by the sensor to each other.

10. The sensor of claim 9 wherein the electronic circuitry is further programmed to produce a selected effect upon successive states of a prescribed sequence being transmitted thereto from the sensor.

11. A sensor for use in an interactive electronic device, the sensor comprising:

a base member defining first and second axes which extend in generally perpendicular relation to each other and having at least two circularly configured recesses formed therein, each of the recesses being partially defined by a respective peripheral wall of the base member, with each of the first and second axes extending axially through a respective one of the recesses;

at least two switches disposed within the peripheral wall of each of the recesses in spaced relation to each other; and a trigger mechanism disposed within each of the recesses and freely moveable about the peripheral wall thereof;

the, sensor being operative to generate different states corresponding to respective positions of the sensor relative to a reference plane, with a low state being generated when the trigger mechanisms are not in contact with any of the switches and at least nine different high states being generated corresponding to contact between the trigger mechanisms and at least one of the switches.

12. The sensor of claim 11 wherein:

the base member comprises two separate base member sections which define respective ones of the first and second axes; and the recesses are formed within respective ones of the base member sections, with the first and second axes extending axially through respective ones of the recesses;

the base member sections being attachable to a device such that the first and second axes extend in generally perpendicular relation to each other.

13. The sensor of claim 11 further in combination with programmable electronic circuitry which is in electrical communication with the sensor and is operative to translate at least some of the states generated by the sensor into respective effects.

14. The sensor of claim 13 wherein the electronic circuitry is programmed to compare at least two successive states generated by the sensor to each other.

15. The sensor of claim 14 wherein the electronic circuitry is further programmed to produce a selected effect upon successive states of a prescribed sequence being transmitted thereto from the sensor.

16. A sensor for use in an interactive electronic device, the sensor comprising:

a base member defining first, second and third axes which extend in generally perpendicular relation to each other and having at least three circularly configured recesses formed therein, each of the recesses being partially defined by a respective peripheral wall of the base member, with each of the first, second and third axes extending axially through a respective one of the recesses;

at least two switches disposed within the peripheral wall of each of the recesses in spaced relation to each other; and a trigger mechanism disposed within each of the recesses and freely moveable about the peripheral wall thereof;

the sensor being operative to generate different states corresponding to respective positions of the sensor relative to a reference plane, with a low state being generated when the trigger mechanisms are not in contact with any of the switches and at least twenty-seven different high states being generated corresponding to contact between the trigger mechanisms and at least one of the switches.

17. The sensor of claim 16 wherein:

the base member comprises three separate base member sections which define respective ones of the first, second and third axes; and the recesses are formed within respective ones of the base member sections, with the first, second and third axes extending axially through respective ones of the recesses;

the base member sections being attachable to a device such that the first, second and third axes extend in generally perpendicular relation to each other.

18. The sensor of claim 16 further in combination with programmable electronic circuitry which is in electrical communication with the sensor and is operative to translate at least some of the states generated by the sensor into respective effects.

19. The sensor of claim 18 wherein the electronic circuitry is programmed to compare at least two successive states generated by the sensor to each other.

20. The sensor of claim 19 wherein the electronic circuitry is further programmed to produce a selected effect upon successive states of a prescribed sequence being transmitted thereto from the sensor.

21. A sensor for use in an interactive electronic device, the sensor comprising:

a base mount defining at least first and second faces which extend in generally perpendicular relation to each other;

at least two switches attached to each of the first and second faces in spaced relation to each other; and a sensor arm rotatably connected to each of the first and second faces, each of the sensor arms including a magnet which produces a magnetic field, the switches being oriented relative to the sensor arms such that the switches may be exposed to the magnetic field of a respective one of the magnets upon the rotation of a respective one of the sensor arms;

the sensor being operative to generate different states corresponding to respective positions of the sensor relative to a reference plane, with a low state being generated when none of the switches are exposed to the magnetic field of the magnet of any one of the sensor arms and at least four different high states being generated corresponding to the exposure of respective ones of the switches to the magnetic field of the magnet of a respective one of the sensor arms.

22. The sensor of claim 21 further in combination with programmable electronic circuitry which is in electrical communication with the sensor and is operative to translate at least some of the states generated by the sensor into respective effects.

23. The sensor of claim 22 wherein the electronic circuitry is programmed to compare at least two successive states generated by the sensor to each other.

24. The sensor of claim 23 wherein the electronic circuitry is further programmed to produce a selected effect upon successive states of a prescribed sequence being transmitted thereto from the sensor.

25. A sensor for use in an interactive electronic device, the sensor composing:

a base mount defining first, second and third faces which extend in generally perpendicular relation to each other;

at least two switches attached to each of the first, second and third faces in spaced relation to each other; and a sensor arm rotatably connected to each of the first, second and third faces, each of the sensor arms including a magnet which produces a magnetic field, the switches being oriented relative to the sensor arms such that the switches may be exposed to the magnetic field of a respective one of the magnets upon the rotation of a respective one of the sensor arms;

the sensor being operative to generate different states corresponding to respective positions of the sensor relative to a reference plane, with a low state being generated when none of the switches are exposed to the magnetic field of the magnet of any one of the sensor arms and at least eight different high states being generated corresponding to the exposure of respective ones of the switches to the magnetic field of the magnet of a respective one of the sensor arms.

26. The sensor of claim 25 further in combination with programmable electronic circuitry which is in electrical communication with the sensor and is operative to translate at least some of the states generated by the sensor into respective effects.

27. The sensor of claim 26 wherein the electronic circuitry is programmed to compare at least two successive states generated by the sensor to each other.

28. The sensor of claim 27 wherein the electronic circuitry is further programmed to produce a selected effect upon successive states of a prescribed sequence being transmitted thereto from the sensor.

* * * * *